US011713601B2

(12) United States Patent
Leonardi et al.

(10) Patent No.: US 11,713,601 B2
(45) Date of Patent: Aug. 1, 2023

(54) METHOD FOR OPERATING VEHICLE ENTRY SYSTEM USING TOUCH PAD WITH MECHANICAL EMERGENCY SWITCH ASSEMBLY

(71) Applicant: MAGNA MIRRORS OF AMERICA, INC., Holland, MI (US)

(72) Inventors: Emanuele Leonardi, Pisa (IT); Davide Dente, Pisa (IT); Marco Marlia, Guasticce Collesalvetti (IT)

(73) Assignee: Magna Mirrors of America, Inc., Holland, MI (US)

( * ) Notice: Subject to any disclaimer, the term of this patent is extended or adjusted under 35 U.S.C. 154(b) by 0 days.

(21) Appl. No.: 17/809,051

(22) Filed: Jun. 27, 2022

(65) Prior Publication Data

US 2022/0325565 A1 Oct. 13, 2022

Related U.S. Application Data

(62) Division of application No. 16/125,846, filed on Sep. 10, 2018, now Pat. No. 11,371,270.

(Continued)

(51) Int. Cl.
*E05B 81/90* (2014.01)
*E05F 15/43* (2015.01)

(Continued)

(52) U.S. Cl.
CPC ..... *E05B 81/90* (2013.01); *E05B 81/14* (2013.01); *E05B 81/77* (2013.01); *E05B 81/86* (2013.01);

(Continued)

(58) Field of Classification Search
CPC ..... E05B 81/90; E05B 81/14; E05B 81/77; E05B 81/86; E05F 15/43; E05F 15/622;

(Continued)

(56) References Cited

U.S. PATENT DOCUMENTS 8,400,265 B2 * 3/2013 Sarioglu ..... E05B 17/10 340/5.72
10,633,895 B1 * 4/2020 Salter ..... E05B 81/34

(Continued)

FOREIGN PATENT DOCUMENTS

CN 102162321 8/2011
CN 104968875 10/2015

(Continued)

OTHER PUBLICATIONS

Chinese Office Action and Search Report from the Chinese Patent Office for related Chinese Application No. 201811087774.7 dated Dec. 16, 2020, English Translation of Chinese Office Action and Search Report Included.

*Primary Examiner* — Mark A Williams
(74) *Attorney, Agent, or Firm* — Honigman LLP

(57) ABSTRACT

A method of operating an entry system of a motor vehicle includes monitoring a battery voltage and the entry system continuously using a control circuit of the latch assembly in a non-emergency mode. Power is provided to the control circuit in the event of a loss of power from a main power source using a backup energy source of the control circuit. The method includes transitioning to an emergency mode in response to determining loss of power from the main power source or failure of the component of the entry system. An actuation group associated with the latch assembly is operated with the control circuit using power from the backup energy source of the control circuit in response to determining that actuation from a plurality of pins of a mechanical emergency switch assembly indicates a command from a user to unlatch the closure member in the emergency mode.

22 Claims, 16 Drawing Sheets

Related U.S. Application Data

(60) Provisional application No. 62/559,908, filed on Sep. 18, 2017.

(51) Int. Cl.
*E05F 15/622* (2015.01)
*E05B 81/14* (2014.01)
*E05B 81/76* (2014.01)
*E05B 81/86* (2014.01)

(52) U.S. Cl.
CPC ..... *E05F 15/43* (2015.01); *E05F 15/622* (2015.01); *E05F 2015/433* (2015.01); *E05Y 2400/502* (2013.01); *E05Y 2400/512* (2013.01); *E05Y 2400/54* (2013.01); *E05Y 2400/61* (2013.01); *E05Y 2400/612* (2013.01); *E05Y 2900/50* (2013.01)

(58) Field of Classification Search
CPC ..... E05F 2015/433; E05Y 2400/502; E05Y 2400/512; E05Y 2400/54; E05Y 2400/61; E05Y 2400/612; E05Y 2900/50
See application file for complete search history.

(56) References Cited

U.S. PATENT DOCUMENTS

| | | | | |
|---|---|---|---|---|
| 11,230,338 | B2 * | 1/2022 | Salvaggio, Jr. | B62J 35/00 |
| 11,371,270 | B2 | 6/2022 | Leonardi et al. | |
| 2010/0219935 | A1 | 9/2010 | Single et al. | |
| 2010/0235059 | A1 | 9/2010 | Krishnan et al. | |
| 2011/0057773 | A1 | 3/2011 | Newman | |
| 2012/0192602 | A1 * | 8/2012 | Bacon | E05B 47/026 70/278.1 |
| 2014/0000165 | A1 * | 1/2014 | Patel | E05B 81/77 292/201 |
| 2015/0353033 | A1 | 12/2015 | Pribisic et al. | |
| 2015/0360646 | A1 * | 12/2015 | Pribisic | G06F 3/0447 340/5.54 |
| 2016/0347269 | A1 * | 12/2016 | Breed | B60R 16/0215 |
| 2017/0292310 | A1 * | 10/2017 | Podkopayev | E05C 17/006 |
| 2017/0335606 | A1 * | 11/2017 | Schatz | G06F 3/03547 |
| 2018/0016810 | A1 * | 1/2018 | Bacon | E05B 81/66 |
| 2019/0085600 | A1 * | 3/2019 | Leonardi | E05B 81/90 |
| 2019/0152433 | A1 | 5/2019 | Cumbo | |
| 2019/0153768 | A1 | 5/2019 | Termine et al. | |
| 2019/0376324 | A1 * | 12/2019 | Walawender | E05B 17/10 |
| 2021/0301561 | A1 * | 9/2021 | Gumbo | E05B 83/36 |

FOREIGN PATENT DOCUMENTS

| | | |
|---|---|---|
| CN | 105313836 | 2/2016 |
| CN | 106168087 | 11/2016 |
| CN | 106996228 | 8/2017 |
| DE | 102011100036 | 10/2012 |
| EP | 0694664 | 1/1996 |
| WO | 2014102282 | 7/2014 |

* cited by examiner

METHOD FOR OPERATING VEHICLE ENTRY SYSTEM USING TOUCH PAD WITH MECHANICAL EMERGENCY SWITCH ASSEMBLY

CROSS-REFERENCE TO RELATED APPLICATIONS

This utility application is a divisional of U.S. patent application Ser. No. 16/125,846, filed Sep. 10, 2018, now U.S. Pat. No. 11,371,270, and claims the benefit of U.S. provisional application Ser. No. 62/559,908, filed Sep. 18, 2017. The entire disclosure of the above application is incorporated herein by reference.

FIELD OF THE INVENTION

The present disclosure relates generally to an entry system for motor vehicles and, more particularly to a capacitive touch pad with mechanical emergency switch assembly for an electronic vehicle entry system. The present disclosure also relates to a method of operating the vehicle entry system.

BACKGROUND OF THE INVENTION

This section provides background information related to the present disclosure which is not necessarily prior art.

It is known that electrical latches (e-latch) are provided in motor vehicles, for example, for controlling the opening and closing of various closure panels such as passenger doors and lift gates. One of the defining characteristics of an e-latch is that it does not include a mechanical linkage to an outside or inside door handle. Instead, the door is released by a power-operated actuator in response to an electrical signal coming from one of the handles. The e-latch generally includes a latching mechanism having a ratchet that is selectively rotatable with respect to a striker fixed to a door post in order to latch and unlatch the door. The latching mechanism also generally includes a pawl that selectively engages the ratchet to prevent the ratchet from rotating. The e-latch also typically includes a power-operated actuator, such as an electric motor, which is electrically connected to a main power supply of the vehicle (e.g., the 12V battery of the vehicle) in order to directly or indirectly drive the pawl.

Because a common problem related to e-latches is that of controlling opening and closing of the doors or closure members in the case of a failure of the main power supply, a backup power source for the e-latch can be provided to supply electrical energy to the electric motor of the latch. EP 0 694 664 A1 discloses a backup energy source for an electrical door latch designed to supply power to the latch during emergency situations and which includes an auxiliary battery arranged within the door in order to power the release of the striker from the ratchet to facilitate opening of the door by the vehicle occupant. WO2014/102282 discloses a backup energy source for an electrical door latch that is designed to supply power to the electric motor during emergency situations and which includes a super capacitor group configured to store energy during normal operating conditions and supply a backup supply voltage to the electric motor during failure operating conditions.

Additionally, door opening/closing systems are moving towards the elimination of traditional mechanical handles/unlock switches by replacing such door handles/unlock switches with electronic sensors i.e. touch pad entry/touchless sensors. For example, a capacitive touch pad may be provided to replace an external handle or unlock switch which is in communication with the electronic latch to command the unlatching/opening of the latch. As part of such an electronic entry system, a door unlatch may be commanded with a "soft touch" on the capacitive touch pad/sensor (i.e. the capacitive touch pad requests a door unlatch to the e-latch through a hardwire connection or via the communication bus between the capacitive touch pad and the e-latch).

Capacitive sensors require power to operate, and thus due to the possibility of power failures or failure of the touch pad/sensor, the physical handle cannot fully be replaced by the touch pad since the door or closure member must still be able to be opened in the case of a failure in the operation of the entry sensor/system. For example, in the event of a lack of power (i.e. battery disconnect, dead battery, broken wire, or even a broken sensor) the door cannot be opened from the outside since the sensor and sensor microcontroller cannot be powered. In the case where a backup power system is provided, the entry sensors still may draw significant power to deplete the back-up energy source.

Accordingly, there remains a need for improved touch pads for entry systems used on motor vehicles and methods of operation thereof that allow a user to directly command the operation of the electronic latch in the case of an operational failure of the electronic entry sensor.

SUMMARY OF THE INVENTION

This section provides a general summary of the present disclosure and is not a comprehensive disclosure of its full scope or all of its features and advantages.

It is an object of the present disclosure to provide an entry system and a touch pad for the entry system for use in a motor vehicle that addresses and overcomes the above-noted shortcomings.

Accordingly, it is an aspect of the present disclosure to provide a touch pad for operating an e-latch assembly of a motor vehicle entry system including a control circuit having a backup energy source. The touch pad includes a touch pad controller in communication with the control circuit of the e-latch assembly. The touch pad also includes at least one entry input sensor coupled to the touch pad controller for outputting a signal indicative of a command to operate the e-latch assembly. Finally, the touch pad includes a mechanical emergency switch assembly adjacent the at least one entry input sensor and including a plurality of pins electrically coupled to the control circuit of the e-latch assembly for operating the e-latch assembly when the at least one entry input sensor is not operable due to one of a power loss and malfunction of the at least one entry input sensor.

According to another aspect of the disclosure, an entry system for a closure member of a motor vehicle is also provided. The entry system includes an e-latch assembly that has a control circuit including a control unit normally powered by a main power source of the motor vehicle. The control circuit is configured to operate an actuation group operable to control actuation of the closure member. The control circuit of the e-latch assembly includes a backup energy source to provide power to the control unit and the actuation group in the event of a loss of power from the main power source. The entry system also includes a touch pad that has a touch pad controller in communication with the control circuit. The touch pad also includes at least one entry input sensor coupled to the touch pad controller for outputting a signal indicative of a touch to operate the e-latch assembly. The touch pad includes a mechanical emergency switch assembly adjacent the at least one entry input sensor. The mechanical emergency switch assembly includes a plurality of pins electrically coupled to the control circuit of the e-latch assembly for operating the e-latch assembly when the at least one entry input sensor is not operable due to one of a malfunction of the at least one entry input sensor and the loss of power from the main power source.

According to yet another aspect of the disclosure, a method of operating an entry system of a motor vehicle including an e-latch assembly, is also provided. The method begins with the step of monitoring a battery voltage and the entry system continuously using a control circuit of the e-latch assembly in a non-emergency mode. The next step of the method is providing power to the control circuit in the event of a loss of power from a main power source using a backup energy source of the control circuit. The method proceeds by determining one of the loss of power from the main power source and a failure of a component of the entry system using the control circuit. The method continues with the step of transitioning to an emergency mode in response to determining one of the loss of battery power and the component failure of the entry system. The method also includes the step of polling a plurality of pins of a mechanical emergency switch assembly of a touch pad associated with a closure member of the vehicle using the control circuit for the actuation of the mechanical emergency switch assembly in the emergency mode. The next step is determining whether the actuation from the plurality pins of the mechanical emergency switch assembly indicate a command from a user to unlatch the closure member using the control circuit in the emergency mode. The method concludes with the step of operating an actuation group associated with the e-latch assembly with the control circuit using power from the backup energy source of the control circuit in response to determining that the actuation from the plurality pins of the mechanical emergency switch assembly indicate the command from the user to unlatch the closure member in the emergency mode.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DESCRIPTION OF THE PREFERRED EMBODIMENTS

In the following description, details are set forth to provide an understanding of the present disclosure. In some instances, certain circuits, structures and techniques have not been described or shown in detail in order not to obscure the disclosure.

In general, the present disclosure relates to an entry system of the type well-suited for use in many vehicular closure applications. The entry system and associated methods of operation of this disclosure will be described in conjunction with one or more example embodiments. However, the specific example embodiments disclosed are merely provided to describe the inventive concepts, features, advantages and objectives with sufficient clarity to permit those skilled in this art to understand and practice the disclosure. Specifically, the example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the several views, an entry system including a touch pad for a motor vehicle and a method of operating the entry system are disclosed.

Figure 1:
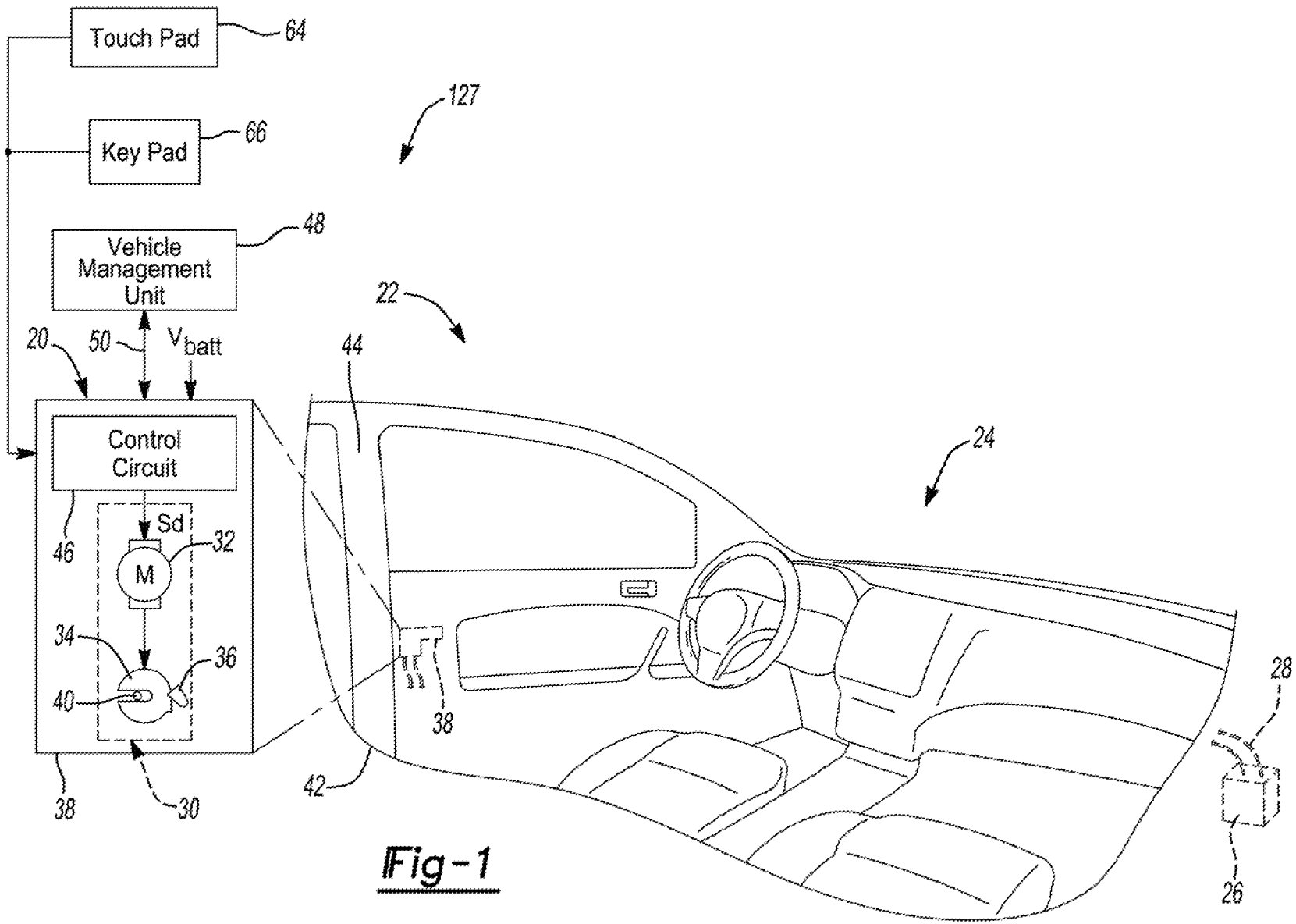
FIG. 1 illustrates an entry system including an electrical latch assembly (e-latch assembly) functionally and operatively arranged in association with a door of a motor vehicle according to aspects of the disclosure.

Number 20 in FIGS. 1 and 2 indicates as a whole an electronic latch assembly (hereinafter e-latch assembly 20), coupled to a front closure panel or front door 22 of a motor vehicle 24. It should be understood that the e-latch assembly 20 can be coupled to any kind of closure device of the motor vehicle 24, such as, but not limited to passenger doors, liftgates, trunk lids and hoods.

The e-latch assembly 20 is electrically connected to a main power source 26 of the motor vehicle 24, for example a main battery providing a battery voltage Vbatt of 12 Volts, through an electrical connection element 28, for example a power cable. The main power source 26 may also include a different source of electrical energy within the motor vehicle 24, such as an alternator, for example.

The e-latch assembly 20 is configured to include an actuation group 30 having one or more electric motor(s) 32 operable to control actuation of the front door 22 (or in general control actuation of the vehicle closure device). In one possible embodiment, the actuation group 30 includes a latching mechanism 34, 36 having a ratchet 34 and a pawl 36. Ratchet 34 is rotatably mounted to a latch housing 38 and is selectively rotatable to engage a striker 40 (fixed to a vehicle body 42 of the motor vehicle 24, for example to the so called A-pillar or B-pillar 44, in a manner not shown in detail). Ratchet 34 is rotatable between an unlatched (striker release) position, a secondary latched/closed (secondary striker capture) position and a primary latched/closed (primary striker capture) position and is normally biased toward the unlatched position. When the ratchet 34 is rotated into one of the latched positions with respect to the striker 40, the front door 22 is in a closed state, as either latched and cinched or latched and uncinched. Pawl 36 is also rotatably mounted to latch housing 38 and is moveable between a ratchet release position and one or more ratchet holding positions. Movement of pawl 36 to its ratchet release position permits ratchet 34 to move to its unlatched position. In contrast, movement of pawl 36 to its ratchet holding positions functions to hold ratchet 34 in one of its latched/closed positions. The pawl 36 is directly or indirectly driven by the electric motor 32 associated with a power actuator mechanism so as to move between its ratchet holding positions (e.g., a primary ratchet holding position for holding the ratchet 34 in its primary closed position and a secondary ratchet holding position for holding the ratchet 34 in its secondary closed position) and its ratchet release position. The pawl 36 is normally biased to continuously engage the ratchet 34.

Figure 2:
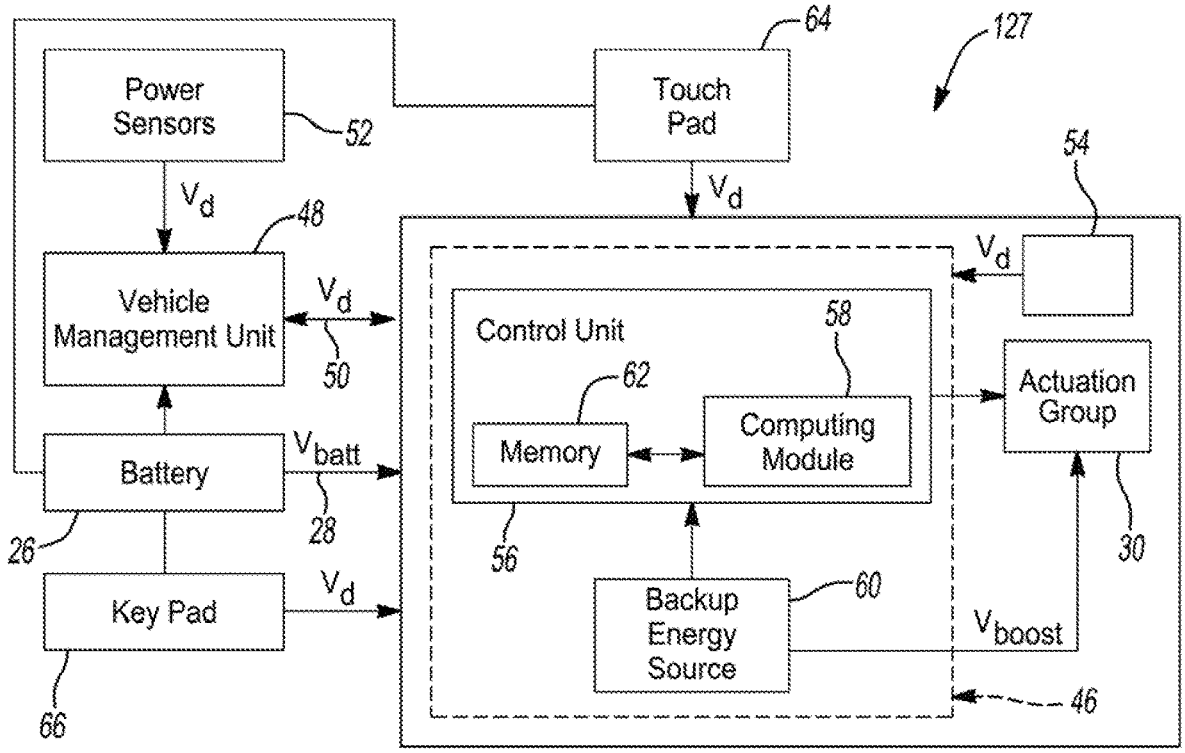
FIG. 2 is a schematic illustration of an electronic control circuit operably associated with the e-latch assembly of FIG. 1 according to aspects of the disclosure.

As best shown in FIG. 2, the e-latch assembly 20 further includes an electronic control circuit 46, for example including a microcontroller or other known computing unit (discussed in detail below). The electronic control circuit 46 is coupled to the actuation group 30 and provides suitable driving signals Sd to the electric motor 32. The electronic control circuit 46 can be conveniently embedded and arranged in the latch housing 38 (shown schematically) together with the actuation group 30 of the e-latch assembly 20, thus providing an integrated compact and easy-to-assemble unit, for example.

The electronic control circuit 46 is also electrically coupled to a vehicle management unit 48, such as for example a Body Control Module (BCM) commonly known in the art, which is configured to control general operation of the motor vehicle 24 via an electrical connection bus 50 (e.g., a data bus), so as to exchange signals, data, commands and/or information Vd indicative of a state of the vehicle. Such information and/or signals Vd may include, for example, positioning of the individual components of the actuation group 30, state of the main power source 26, and/or circuit integrity of the main power source 26 connection to the electronic control circuit 46, and/or vehicle management unit 48.

The vehicle management unit 48 is additionally coupled to electrical system sensors 52 (FIG. 2), for example voltage, current and/or power sensors, which can provide signals Vd to the vehicle management unit 48 and/or the electronic control circuit 46. The signals Vd from the electrical system sensors 52 can include information such as, but not limited to the state of the main power source 26 and electrical connections of same to the e-latch assembly 20, as well as current lock state of the e-latch assembly 20.

Conveniently, the electronic control circuit 46 receives feedback information about the latch actuation status from position sensors 54, such as Hall sensors, configured to detect the operating position of the actuation group 30 (e.g. latched state, unlatched state locked state, unlocked state, opened state, closed state, cinched state, uncinched state, etc.), for example of the ratchet 34 and/or pawl 36 and/or cinching lever (not shown) and/or striker 40; and also receives (directly and/or indirectly via the vehicle management unit 48) information Vd about user commands to open/unlock/unlatch or lock the front door 22 of the motor vehicle 24.

The electronic control circuit 46 can also be coupled to the main power source 26 of the motor vehicle 24, so as to receive the battery voltage Vbatt whereby the electronic control circuit 46 is able to check if the value of the battery voltage Vbatt decreases below a predetermined threshold value.

The electronic control circuit 46 also includes a control unit 56, for example provided with a microcontroller, processor or analogous computing module 58, that is coupled to a backup energy source 60 and the actuation group 30 of the e-latch assembly 20 (providing thereto the driving signal Sd), to control their operation. The power to generate the driving signals Sd as well as operational power for the electric motor 32 can be provided by the main power source 26, and in the event of a fault condition of the main power source 26, the power is provided by the backup energy source 60. While the backup energy source 60 is illustratively shown as embedded within the e-latch assembly 20, other placements, such as external and in electrical communication with the e-latch assembly 20 as provided within an interior chamber 96 of front door 22 for example are possible.

The control unit 56 also has an embedded memory 62, for example a non-volatile random access memory, coupled to the computing module 58, storing suitable programs and computer instructions (for example in the form of a firmware). It is recognized that the control unit 56 could alternatively comprise a logical circuit of discrete components to carry out the functions of the computing module 58 and embedded memory 62, including acting upon the vehicle state signals Vd, touch pad signals Vd, position sensor signals Vd, and/or detected or otherwise recognized fault condition(s) of the main power source 26 from the electrical system sensors 52, as further described below.

The control unit 56 is configured to control the e-latch assembly 20 for controlling actuation of the front door 22 based on signals Vd detected by a touch pad 64 and/or a key pad 66 which are indicative, for example, of the user intention or command to open the front door 22 of the motor vehicle 24, and optionally based on signals Vd received from the vehicle management unit 48 which are indicative, for example, of a correct authentication of the user carrying suitable authentication means (such as in a fob carried by the user) and/or as indication of the state of the motor vehicle 24 (one or more detected or otherwise recognized fault conditions of the main power source 26). It is also recognized that the touch pad 64 and/or key pad 66 can include signals Vd generated due to operation of detection zones, such as via touch of or proximity to the touch pad 64 and/or key pad 66, of other release controls by the vehicle occupant (e.g., hatch or trunk release lever or button located inside of the vehicle).

Of note, while reference to a capacitive based touch pad 64 and a capacitive key pad 66 are made for purposes of illustration of an exemplary embodiment involving a user physically contacting the touch pad 64 or key pad 66, either may also be configured as a touchless (or contactless) type interface whereby physical contact of the touch pad 64 or key pad 66 is not necessarily required for signals Vd to be generated. For example, the touch pad 64 may be capacitive based whereby a swipe or hover of a hand or finger 69 above the touch pad 64 disrupts an electromagnetic field 71 generated by the touch pad 64 there above is sufficient to register an indication to activate a vehicle function associated with the touch pad 64, such as an door unlatch command. As another example, other types of proximity sensors may be employed, such as radar based sensors.

According to a particular aspect, the control unit 56 is also configured to manage open/unlatch or unlock signals Vd received from the touch pad 64 and to implement a suitable control algorithm to control the same e-latch assembly 20 to facilitate release of the striker 40 from the ratchet 34 (e.g., when opening/unlatching) and/or engagement of the striker 40 from the ratchet 34 of actuation group 30 of the e-latch assembly 20 (e.g., when latching).

Further, the signals Vd can be interpreted by the vehicle management unit 48 and/or the control unit 56 to represent one or more of a variety of state conditions experienced by the vehicle and/or the e-latch assembly 20. For example, the state conditions can be fault condition(s) of the main power source 26 (including connection circuit failure between the main power source 26 and the e-latch assembly 20), operational position of components in the actuation group 30, and/or emergency conditions of the motor vehicle 24 itself (e.g., a crash condition). It is also recognized that fault condition(s) of the main power source 26 can include failure of the battery and/or alternator considered as part of the main power source 26.

In particular, the control unit 56 can, in view of receiving from the vehicle management unit 48 the vehicle state information signal Vd (e.g. indicative of one or more fault conditions of the main power source 26), position sensor 54 signals (e.g., indicative of latched state of the e-latch assembly 20), and/or door actuation signals Vd received from the touch pad 64 and/or key pad 66 (e.g., indicative of desire of vehicle occupant to open the front door 22), start, or otherwise operate the e-latch assembly 20, internally to the e-latch assembly 20, in order to provide for opening or unlatching of the front door 22 of the motor vehicle 24 in the event of fault(s) being experienced by the main power source 26 at the beginning of and/or in the midst of operation of actuation group 30.

The integrated backup energy source 60 can be a "passive" device accessed by the e-latch assembly 20, such that the backup energy source 60 is available to backup power the e-latch assembly 20 in the event that the main power source 26 is not available. For example, the current demanded by the e-latch assembly 20 (e.g., electric motor 32 and associated actuators) will draw from whichever source has the highest voltage potential at the time of current draw using an additional control circuit (not shown), for example, comprised of diodes, resistors and other similar solid state devices well known in the art of electric circuit design. In the passive mode for the backup energy source 60, signals from the electrical system sensors 52 can be optionally reported to the control unit 56.

The backup energy source 60 can include a group of low voltage supercapacitors (hereinafter supercap group), as an energy supply unit (or energy tank) to provide power backup to the e-latch assembly 20 even in case of power failures of the main power source 26. Supercapacitors may include electrolytic double layer capacitors, pseudocapacitors or a combination thereof. Supercapacitors advantageously provide high energy density, high output current capability and have no memory effects; moreover, supercapacitors have small size and are easy to integrate, have extended temperature range, long lifetime and may withstand a very high number of charging cycles. Supercapacitors are not toxic and do not entail explosive or fire risks, thus being suited for hazardous conditions, such as for automotive applications.

Accordingly, the electronic control circuit 46 and actuation group 30 are normally powered by the main power source 26 of the motor vehicle 24 and any failure affecting the vehicle management unit 48 and/or the main power source 26 of the motor vehicle 24 does not affect the proper management of the vehicle closure devices (for example the unlocking and/or unlatching front door 22), even during emergency situations.

Figure 3:
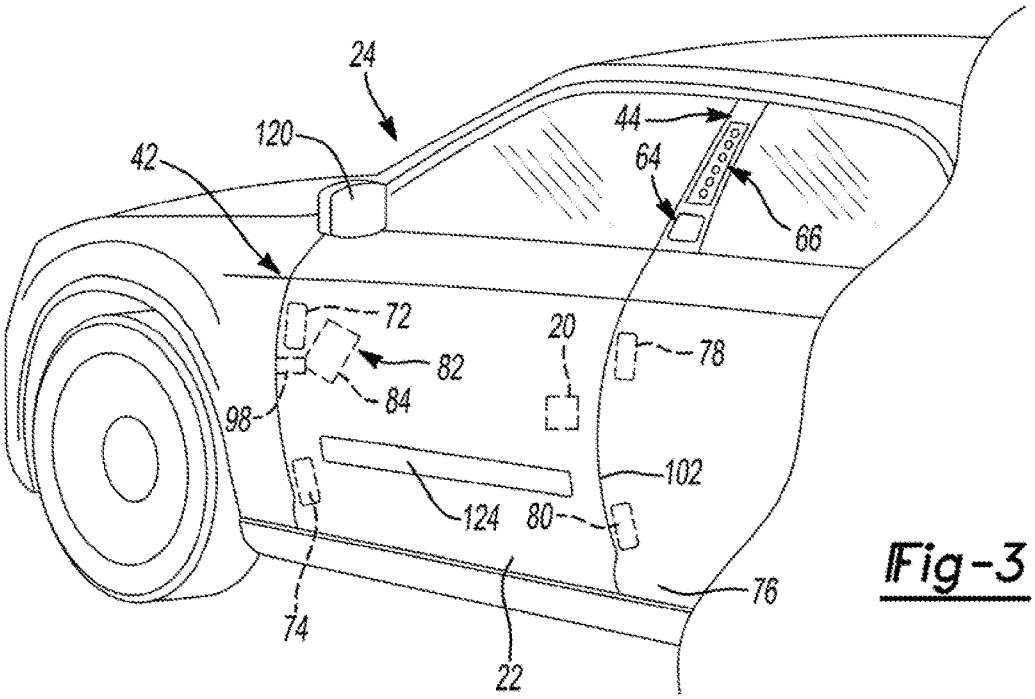
FIG. 3 is a partial perspective side view of the motor vehicle equipped with a touch pad and a key pad of a vehicle entry system according to aspects of the disclosure.

FIG. 3 shows a different view of the motor vehicle 24. As shown, the motor vehicle 24 includes the front closure panel or front door 22 pivotably mounted to the vehicle body 42 via front upper hinge 72 and front lower hinge 74 for swinging movement between a closed position (shown) and a fully-open position. Motor vehicle 24 is also shown including a rear closure panel or rear door 76 pivotably mounted to a central pillar or B-pillar 44 of vehicle body 42 via rear upper hinge 78 and rear lower hinge 80 for swinging movement between a closed position (shown) and a fully-open position. Front door 22 and rear door 76 are shown to be configured without outside door handles so as to each define a "handleless" closure member that is part of a closure panel system, also referred to as power door actuation system 82. In an alternate configuration, an outside handle 53 as illustrated in phantom outline may be provided.

Power door actuation system 82 is shown schematically to include the e-latch assembly 20 and a presenter assembly 84. E-latch assembly 20 is mounted to the rear of front door 22 and in addition to the latching mechanism 34, 36 described above includes (in this non-limiting configuration) a power-operated lock mechanism (not shown). As mentioned above, the e-latch assembly 20 is defined to be operating in a locked-latched mode when the latch mechanism is latched and the lock mechanism is locked for holding front door 22 in a locked-closed position. E-latch assembly 20 is also defined to be operating in an unlocked-latched mode when the latching mechanism 34, 36 (FIG. 1) is latched and the lock mechanism is unlocked for holding front door 22 in an unlocked-closed position. Finally, e-latch assembly 20 is defined to be operating in an unlatched mode when the latching mechanism 34, 36 is released and the lock mechanism is unlocked so as to permit movement of front door 22 from its unlocked-closed position toward a fully-open position. As explained above the electric motor 32 controls operation of the latch release. According to another aspect, the control unit 56 is also configured to manage unlock signals Vd received from the touch pad 64 and to implement a suitable control algorithm to control the same e-latch assembly 20 to control a power-operated lock mechanism (not shown), for example for shifting the power operated lock mechanism from a locked state to an unlocked state, to subsequently allow a manually actuated release of the striker 40 from the ratchet 34 (e.g., when opening/unlatching) when the power operated lock mechanism is in the unlocked state, for example as actuated by an inside handle 51 or an outside handle 53 if provided, mechanically connected (directly or indirectly) to the pawl 36 via bowden cables 55, or electrically connected to the control unit 56 via electrical wiring 57, to move the pawl 36 either mechanically in the former configuration, or electrically through control of the electric motor 32 by the controller unit 56 in the latter configuration, to the ratchet release position to permit ratchet 34 to move to its unlatched position. It is recognized that the power operated lock mechanism may be implemented electronically by the control unit 56 such that an activation of the inside handle 51 or an outside handle 53 if provided will not prompt the control unit 56 to issue a driving signal to the electric motor 32.

Figure 4:
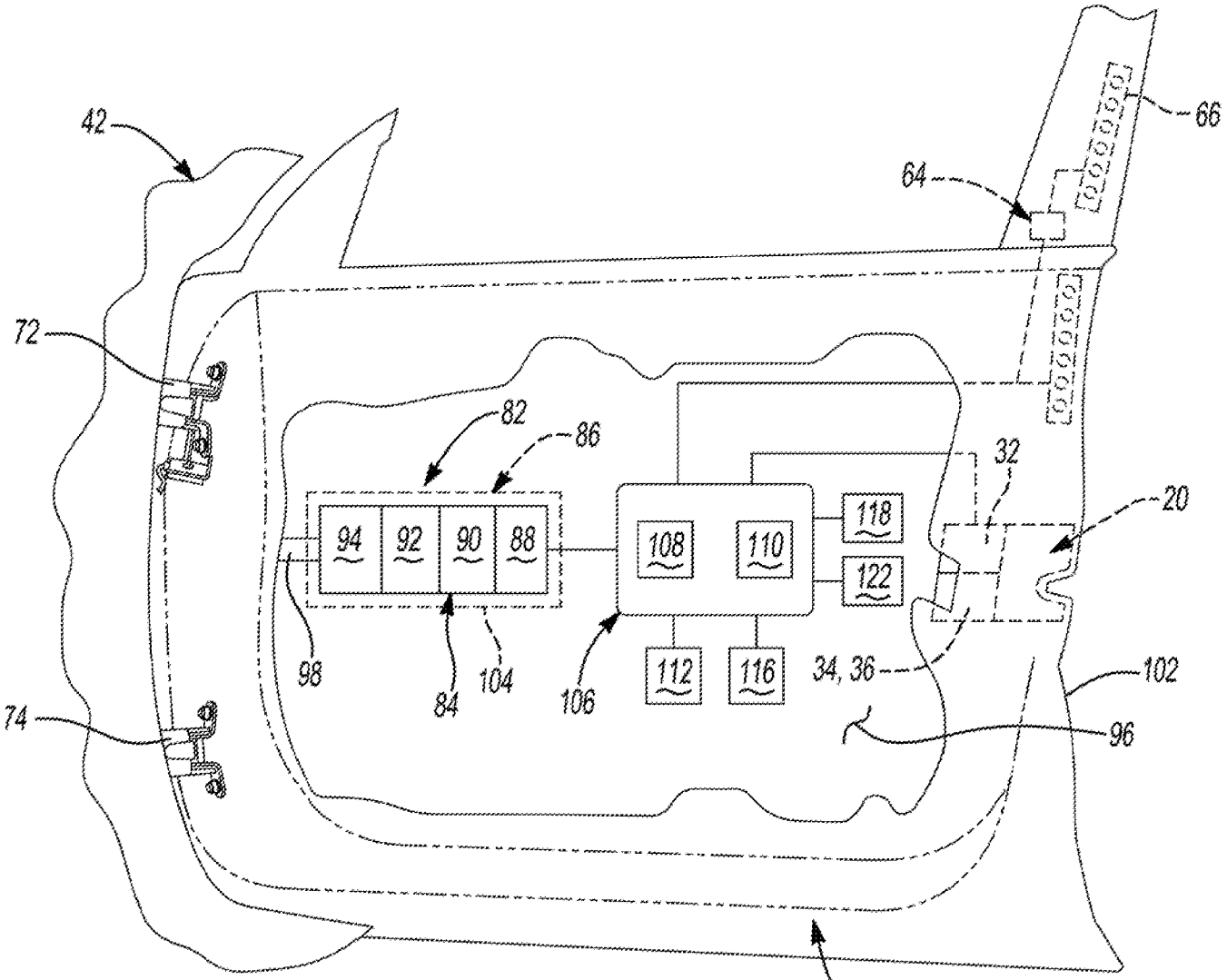
FIG. 4 is a diagrammatic view of a portion of a closure panel of the motor vehicle shown in FIG. 3, with various components removed for clarity purposes only, in relation to a portion of a vehicle body and which is equipped with the e-latch assembly and a presenter assembly according to aspects of the disclosure.

Power door actuation system 82 is diagrammatically shown in FIG. 4 to include a power-operated swing door presenter mechanism, also referred to as power swing door actuator 86, comprised of an actuator motor 88, a reduction geartrain 90, a slip clutch 92, and a drive mechanism 94 which together define powered door presenter assembly 84 that is mounted within an interior chamber 96 of front door 22. Examples of presenter assemblies 84 are shown in commonly-owned U.S. application Ser. No. 15/473,713, titled "Power Swing Door Actuator With Articulating Linkage Mechanism", published as U.S. Publication No. US 2017/0292310 A1, the entire application being incorporated by reference herein. Presenter assembly 84 also includes a connector mechanism 98 configured to connect an extensible member of drive mechanism 94 to a portion of vehicle body 42. Other types of presenter mechanisms may be provided, such as those whereby the connector mechanism 98 remains disconnected from a portion of vehicle body 42 and is configured to urge or "push" the front door 22 to a "presented position" (e.g., to create a 20 mm to 70 mm gap between a door edge 102 and the vehicle body 42). Presenter assembly 84 further includes a support structure, such as an actuator housing 104, configured to be secured to front door 22 within interior chamber 96 and to enclose actuator motor 88, reduction geartrain 90, slip clutch 92 and drive mechanism 94 therein. As also shown, an electronic control module 106 is in communication with actuator motor 88 for providing electric control signals thereto. Electronic control system, also referred to electronic control module 106, may include a microprocessor 108 and a memory unit 110 having executable computer readable instructions stored thereon for execution by the microprocessor 108. Electronic control module 106 may include hardware and/or software components. Electronic control module 106 can be integrated into, or directly connected to, actuator housing 104 or may be a remotely located device within door chamber, may be integrated into e-latch assembly 20, and may communicate with electronic control circuit 46.

Although not expressly illustrated, actuator motor 88 can include Hall-effect sensors for monitoring a position and speed of front door 22 during movement between its open and closed positions. For example, one or more Hall-effect sensors may be provided and positioned to send signals to electronic control module 106 that are indicative of rotational movement of actuator motor 88 (e.g., a motor shaft) and indicative of the rotational speed of actuator motor 88, e.g., based on counting signals from the Hall-effect sensor detecting a target on a motor output shaft. In situations where the sensed motor speed is greater than a threshold speed and where the current being supplied to the actuator motor 88 (e.g., as detected by a current sensor or sensing circuitry) registers a significant change in the current draw, electronic control module 106 may determine that the user is manually moving front door 22 while actuator motor 88 is also operating, thus moving front door 22. Electronic control module 106 may then send a signal to actuator motor 88 to stop actuator motor 88 and may even disengage slip clutch 92 (if provided) to facilitate manual override movement. Conversely, when electronic control module 106 is in a power open or power close mode and the Hall-effect sensors indicate that a speed of actuator motor 88 is less than a threshold speed (e.g., zero) and a current spike is registered either directly or indirectly by microprocessor 108 and/or any current sensing circuity, electronic control module 106 may determine that an obstacle is in the way of front door 22, in which case the electronic control system may take any suitable action, such as sending a signal to turn off actuator motor 88. As such, electronic control module 106 receives feedback from the Hall-effect sensors to ensure that a contact obstacle has not occurred during movement of front door 22 from the closed position to the partially-open position, or vice versa. Other position sensing techniques to determine that the front door 22 is being moved, either by the actuator motor 88 and/or a manual user control are also possible.

As is also schematically shown in FIG. 4, electronic control module 106 can be in communication with a remote key fob 112 via wireless communication link 113, and/or touch pad 64 and/or key pad 66, and/or with an external door-mounted switch or door switch 116 as mounted on/to outside handle if 53 provided (e.g., contact such as a piezoelectric switch, or contactless such as a capacitive sensor) for receiving a request from a user to open or close front door 22. Put another way, electronic control module 106 receives a command signal from either remote key fob 112 and/or door switch 116, and/or touch pad 64 and/or key pad 66, to initiate an opening or closing of front door 22. Upon receiving a command, electronic control module 106 proceeds to provide a signal to actuator motor 88 in the form of a pulse width modulated voltage (for speed control) as an example to turn on actuator motor 88 and initiate pivotal swinging movement of front door 22. While providing the signal, electronic control module 106 also obtains feedback from the Hall-effect sensors of actuator motor 88 to ensure that a contact obstacle has not occurred. If no obstacle is present, actuator motor 88 will continue to generate a rotational force to actuate spindle drive mechanism 94. Once front door 22 is positioned at the desired location, actuator motor 88 is turned off and the "self-locking" gearing associated with reduction geartrain 90 causes front door 22 to continue to be held at that location, thereby providing an automatic door checking function. If a user tries to move front door 22 to a different operating position, actuator motor 88 will first resist the user's motion (thereby replicating a door check function) and eventually release and allow front door 22 to move to the newly desired location. Again, once front door 22 is stopped, electronic control module 106 will provide the required power to actuator motor 88 to hold it in that position. If the user provides a sufficiently large motion input to front door 22 (i.e., as is the case when the user wants to close the front door 22), electronic control module 106 will recognize this motion via the Hall effect pulses and proceed to execute a full closing operation for front door 22.

Electronic control module 106 can also receive an additional input from proximity sensors, such as an ultrasonic sensor 118 positioned on a portion of front door 22, such as on a door mirror 120 or the like. Ultrasonic sensor 118 detects if an obstacle, such as another car, tree, or post, is near or in close proximity to front door 22. If such an obstacle is present, ultrasonic sensor 118 will send a signal to electronic control module 106 and electronic control module 106 will proceed to turn off actuator motor 88 to stop movement of front door 22, thereby preventing front door 22 from hitting the obstacle. This provides a non-contact obstacle avoidance system. In addition, or optionally, a contact obstacle avoidance system, such as a pinch detection system, can be placed in motor vehicle 24 which includes a contact sensor 122 mounted to front door 22, such as in association with molding component 124, and which is operable to send a signal to electronic control module 106 that an obstacle is detected, such as a user's finger detected in a gap between the vehicle body 42 and the front door 22.

Power door actuation system 82 is also shown schematically in FIG. 4 with e-latch assembly 20 having the latching mechanism 34, 36 and the electric motor 32. For purposes of illustration only, electronic control module 106 is shown in communication with electric motor 32, if for example electronic control module 106 also acts as a latch controller for controlling operation of e-latch assembly 20 (e.g., if electronic control circuit 46 is integrated with electronic control module 106); however it should be appreciated that electronic control circuit 46 and electronic control module 106 can be distinct controllers associated with e-latch assembly 20 and presenter assembly 84, respectively. Alternatively, electronic control circuit 46 and electronic control module 106 can be integrated within with e-latch assembly 20. Key fob 112, and/or touch pad 64 and/or key pad 66 and/or door switch 116 are again used to authenticate in a combination of manners the user and control the power release (and power lock) function. For example, vehicle entry system 127 may include only the touch pad 64 and key pad 66 used to authenticate the user and control the power release. For example, vehicle entry system 127 may include key fob 112 and key pad 66 used to authenticate the user and touch pad 64 to control the power release. For example, vehicle entry system 127 may include key fob 112 used to authenticate the user and touch pad 64 to control the power release. Other combinations are possible.

Figure 5:
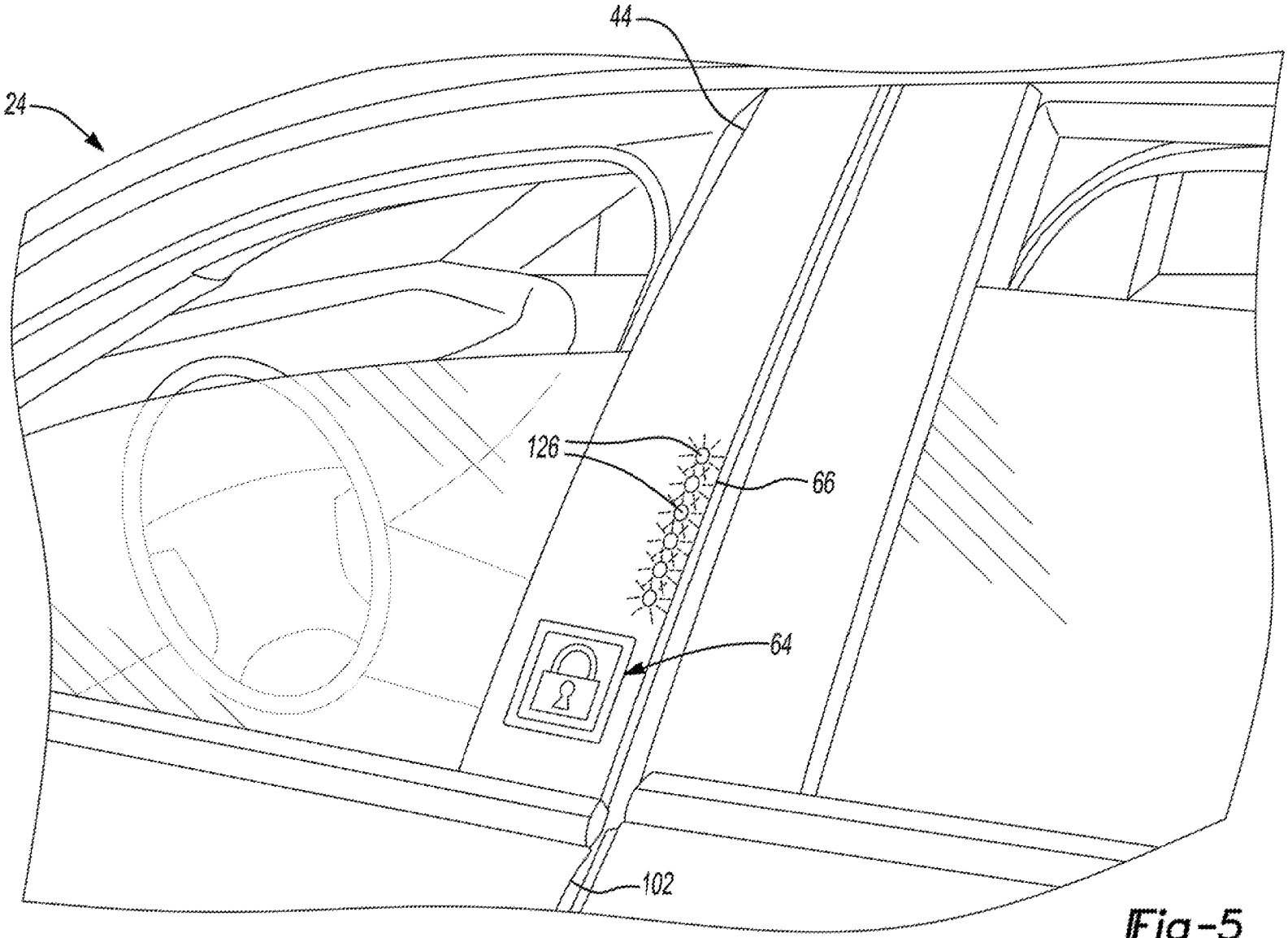
FIG. 5 is an enlarged perspective view of a portion of the closure panel shown in FIG. 3, with the closure panel shown moved to a partially-open position by the presenter assembly and the key pad illuminated according to aspects of the disclosure.

As best shown in FIGS. 3 and 5, the touch pad 64 and/or key pad 66 for operating the e-latch assembly 20 can be attached to the motor vehicle 24 on the front door 22 (e.g., via a B-pillar appliqué 45 as shown in FIG. 5, or on the rear door 76 (e.g., via a B-pillar appliqué 47 as shown in FIG. 3). The key pad 66, for example, can enable an authorized user to enter a passcode consisting of a sequence of alpha or numerical codes and includes at least one key pad light emitting diode 126 (LED) for providing feedback to a user and to indicate the areas in which the passcode may be entered. The touch pad 64 and key pad 66, in combination with the electronic control circuit 46, the e-latch assembly 20, and power door actuation system 82 can comprise a vehicle entry system 127. Upon verification of the passcode entered on the key pad 66 or by operation of the touch pad 64, the control unit 56 (or another controller in communication with the touch pad 64 and/or key pad 66) controls operation of e-latch assembly 20. The touch pad 64 and/or key pad 66 may also be used to control other vehicle operational functions such as, for example, the presenter assembly 84 or power release of the gas tank cover or the tailgate lift system following entry and verification of the correct passcode.

Figure 6A:
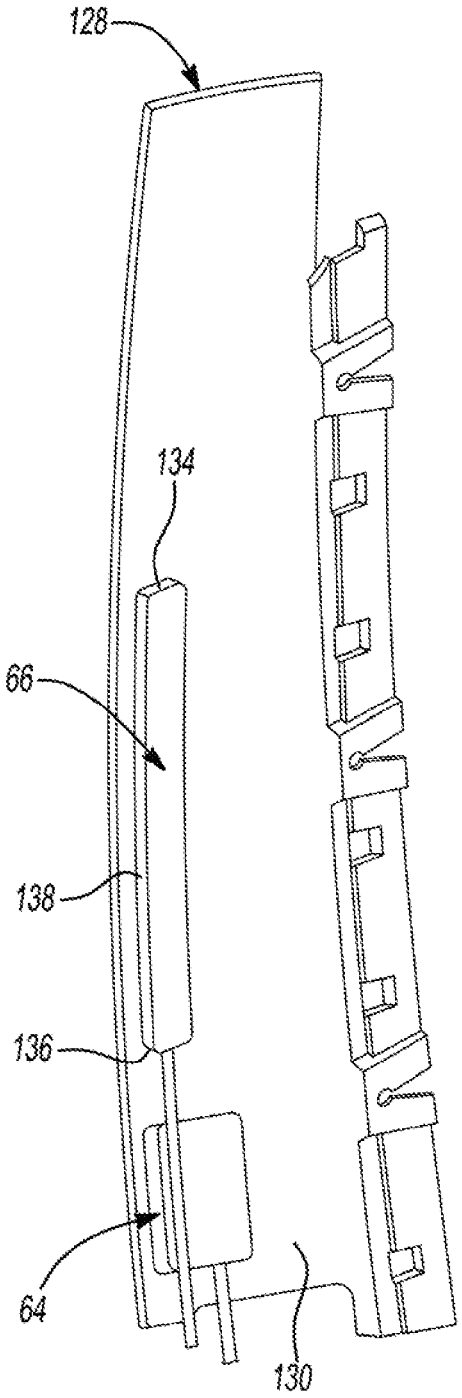
FIG. 6A is a rear perspective view of an applique having the key pad and touch pad mounted to a rear surface of the applique according to aspects of the disclosure.
Figure 6B:
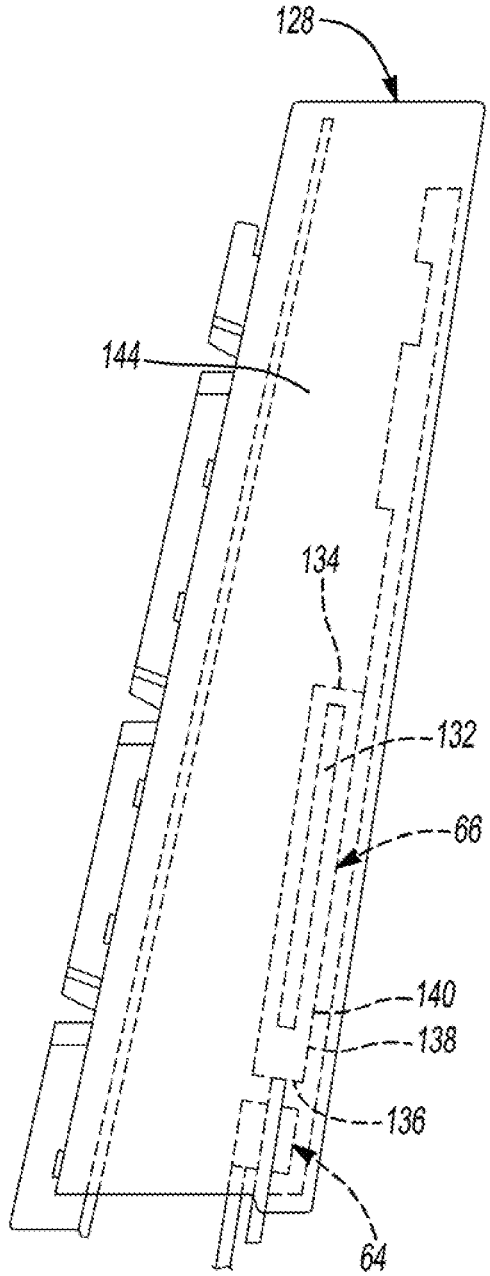
FIG. 6B is a front perspective view of the applique of FIG. 6A having the key pad and touch pad mounted to the rear surface of the applique according to aspects of the disclosure.

As best shown in FIGS. 6A and 6B, in accordance with an illustrative embodiment, the front and rear door edges adjacent the B-pillar 44 (FIG. 5) is covered by a cover plate assembly or applique 128. The key pad 66 and touch pad 64 are mounted to the front and rear door edges adjacent the B-pillar 44 within applique 128 (e.g., on a "dry side", or interior side 130 of the applique 128). In other words, key pad 66 and touch pad 64 are mounted between a structural portion of the front and rear door edges adjacent the B-pillar 44 and applique 128. Specifically, the key pad 66 may be attached to the interior side 130 of the applique 128, behind a transparent or semitransparent portion 132 of the applique 128, and proximate or adjacent the vehicle door edge 102 as an example, using adhesive, interference fit with an integrally molded receptacle on the interior side 130, tape, or screws, fasteners, clips, and the like, for example. As an alternative, the key pad 66 and/or touch pad 64, as shown, could be mounted to front door 22 (e.g. on the rear outer sheet panel of the front door 22) in proximity to vehicle door edge 102 (see key pad 66' and/or touch pad 64' as shown in FIG. 4), in which configuration an aperture in the outer sheet panel of the front door 22 is provided to allow light from the at least one key pad light emitting diode 126 to pass there through. The key pad 66 extends from a first end 134 to a second end 136 and includes a key pad housing 138 made of plastic (e.g., polypropylene) and a key pad cover 140 of clear acrylic attached to the key pad housing 138 to define a compartment. Alternatively, the portion of the applique 128 aligned with the at least one key pad light emitting diode 126 may be semi-transparent for allowing light from the at least one key pad light emitting diode 126 to pass there through to be visible external to the motor vehicle 24 from the front side 144 of the applique 128, while providing some light diffusive properties. In an embodiment, the key pad cover 140 is formed from a portion of the applique 128 which may be transparent or semi-transparent for allowing light from the at least one key pad light emitting diode 126 to pass there through, diffused, or non-diffused, to be visible external to the motor vehicle 24.

Figure 7A:
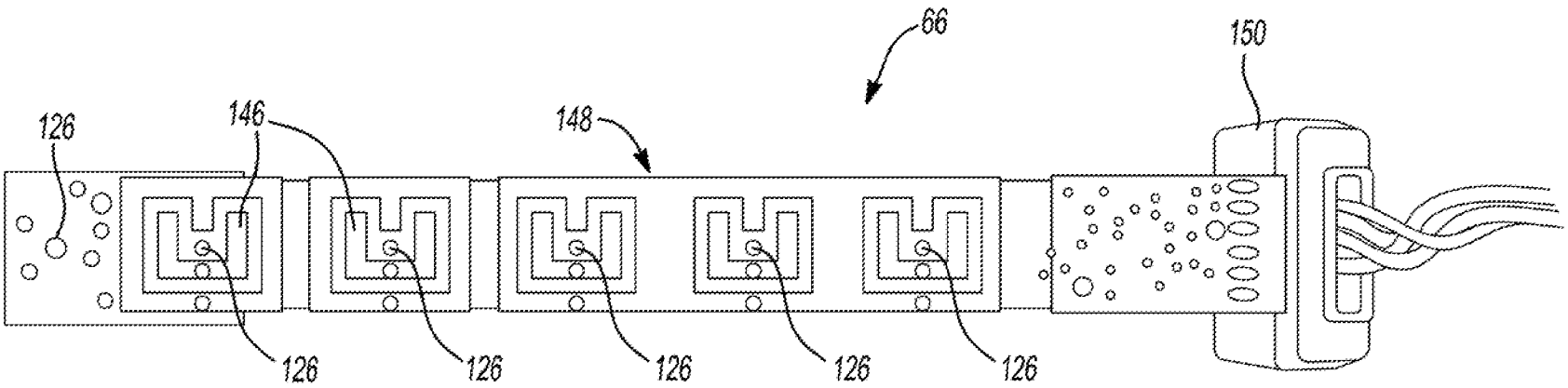
FIGS. 7A and 7B illustrate a key pad printed circuit board of the touch pad according to aspects of the disclosure.
Figure 7B:
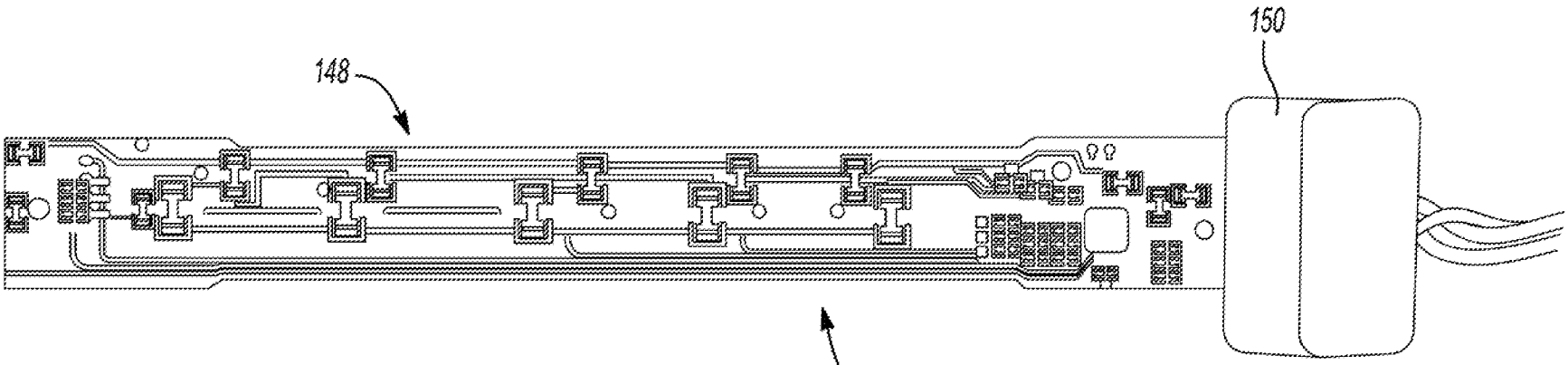

As best shown in FIGS. 7A and 7B, the key pad 66 also includes at least one key pad input sensor 146 (e.g., a plurality of key pad input sensors 146 as shown) coupled to the electronic control circuit 46 for outputting a signal indicative of a selection, such as by a touch to the key pad 66 to operate the e-latch assembly 20. The at least one key pad light emitting diode 126 illuminates an area around the at least one key pad input sensor 146 (i.e., a touch node). The at least one key pad input sensor 146, and at least one key pad light emitting diode 126 can be disposed on a key pad printed circuit board 148 and coupled to the motor vehicle 24 (e.g., electronic control circuit 46) with a key pad connector 150. While the at least one key pad input sensor 146 can be capacitive according to aspects of the disclosure, it should be understood that other types of proximity sensors, such as touch, touchless, or gesture sensors may be used instead.

Figure 8:
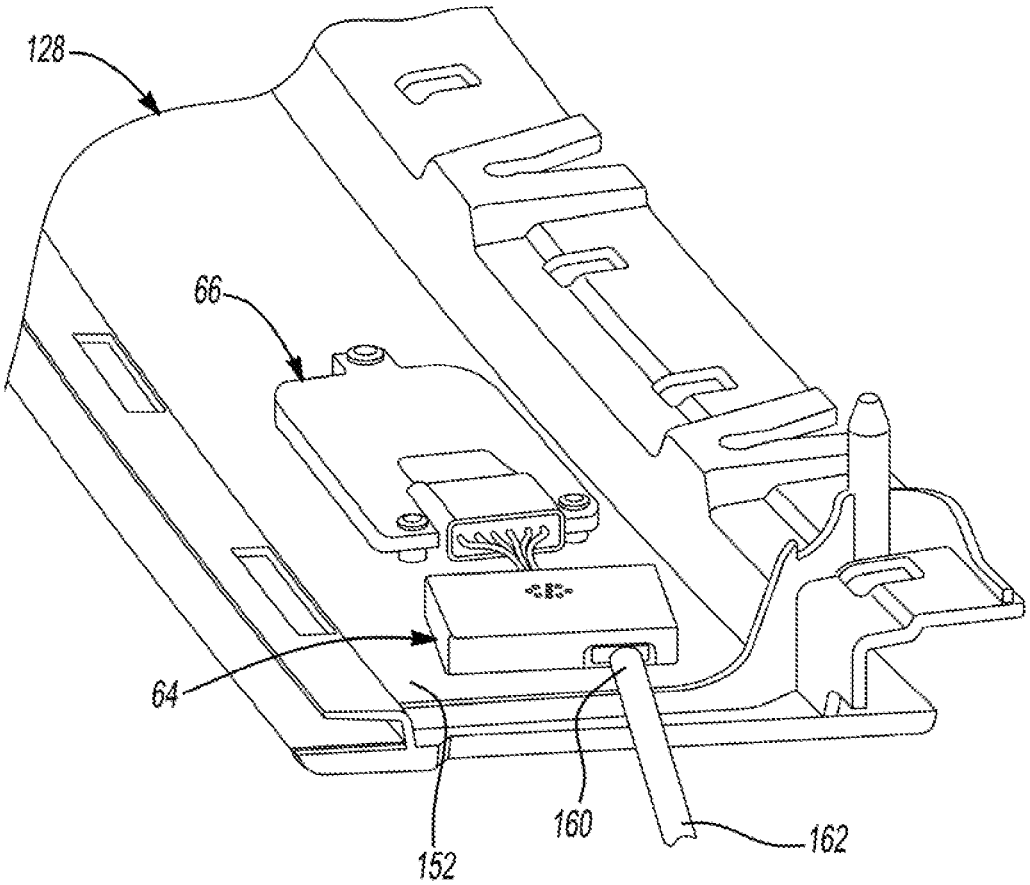
FIG. 8 is an additional view of the key pad and touch pad mounted in the applique according to aspects of the disclosure.
Figure 9:
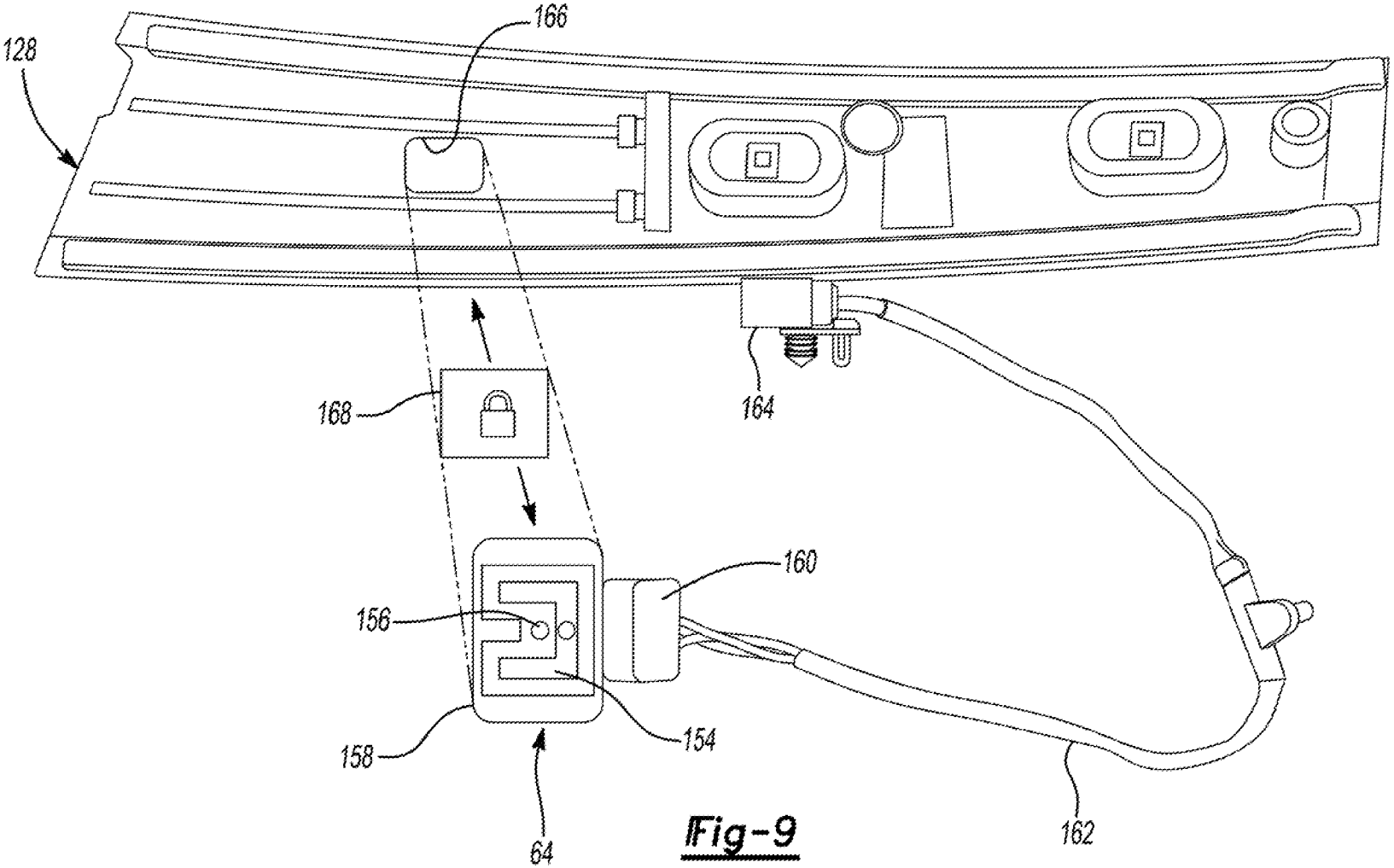
FIG. 9 is an exploded pictorial view of the touch pad of the vehicle entry system according to aspects of the disclosure.

As seen in FIGS. 8 and 9, the applique 128 can include a guide channel 152 configured to receive and retain touch pad 64 and key pad 66 therein. The touch pad 64 also includes at least one entry input sensor 154 for outputting a signal indicative of a touch to the touch pad 64 to operate the e-latch assembly 20. The touch pad 64 can also include at least one touch pad light emitting diode 156 (LED) for illuminating an area around the at least one entry input sensor 154. The at least one entry input sensor 154 and at least one touch pad light emitting diode 156 can be disposed on a touch pad printed circuit board 158 (PCB) and coupled to the motor vehicle 24 (e.g., to electronic control circuit 46) with a touch pad connector 160 and touch pad wiring harness 162 including a touch pad input connector 164. The applique 128 also includes a touch pad opening 166 aligned with the touch pad 64 and a touch pad cover 168 can be disposed in the touch pad opening 166. Although the at least one entry input sensor 154 can be capacitive according to aspects of the disclosure, it should be understood that other types of touch, touchless, or gesture sensors may be used instead.

Because door opening/closing or entry systems are moving towards the elimination of traditional mechanical handles/unlock switches by replacing such door handles/unlock switches with electronic touch pads 64 or sensors for entry, difficulties can arise in the case of a failure in the operation of the entry system. While one solution could be to provide power to the touch pad 64 and/or at least one entry input sensor 154 using the backup energy source 60 of the e-latch assembly 20, an example entry input sensor 154 which is capacitive operating at 13V can consume between 100 and 300 microamps, thereby resulting in an increased rate of depletion of backup power source 60. Such power consumption may be too high to guarantee 12-24 hours of functionality when the entry system is relying on energy from the backup energy source 60. If entry input sensor 154 is not supplied by a backup energy source, such as backup energy source 60, entry input sensor 154 will not be operable in a failure scenario, such as loss of main power source 26.

Figure 10:
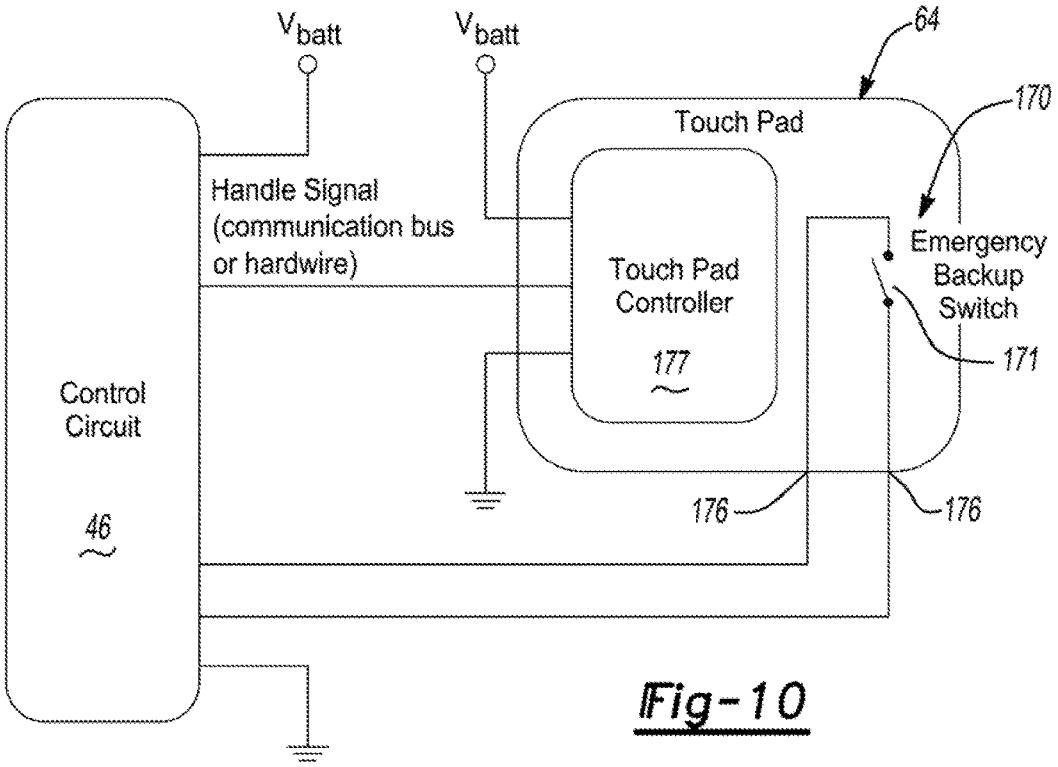
FIG. 10 illustrates a schematic diagram including the touch pad with an mechanical emergency switch assembly coupled to the electronic control circuit of the e-latch assembly of FIG. 1 according to aspects of the disclosure.

Therefore, the touch pad 64 disclosed herein also includes a mechanical emergency switch assembly 170 as shown in FIG. 10. The mechanical emergency switch assembly 170 is adjacent the at least one entry input sensor 154. The term "adjacent" used herein can refer to a position below the at least one entry input sensor 154 (i.e., in a different plane), or a position to the side of the at least one entry input sensor 154 (i.e., within a common plane), but also other positions in proximity to touch pad 64. According to an aspect and as shown in the figures, the mechanical emergency switch assembly 170 is disposed behind one or more of the at least one entry input sensors 154 (e.g., a moveable button supporting the at least one entry input sensor 154). By placing the mechanical emergency switch assembly 170 behind the at least one entry input sensor 154, when the user soft touches the at least one entry input sensor 154, they can activate the at least one entry input sensor 154 before the mechanical emergency switch assembly 170 is activated. Providing a touch pad 64 where a high input force is required to activate the mechanical emergency switch assembly 170 could lead the user to use the backup or mechanical emergency switch assembly 170 only during an emergency condition (for example when the touch pad 64 is damaged or a battery has been disconnected or the touch pad 64 is disabled by the e-latch assembly 20 through communication bus to conserve energy) is present. Because the mechanical emergency switch assembly 170 supports the at least one entry input sensor 154 as part of one unit (i.e., the touch pad 64) space savings may be realized. Also the user only has to touch the same area, either with a soft touch to activate the electronic sensor (i.e., the at least one entry input sensor 154), or with a hard touch to activate the mechanical emergency switch assembly 170. However, it should be appreciated that the mechanical emergency switch assembly 170 could be instead located next to the at least one entry input sensor 154.

Also shown in FIG. 10, the mechanical emergency switch assembly 170 includes a plurality of pins 176 electrically coupled to the electronic control circuit 46 of the e-latch assembly 20 and a switch 171 electrically coupled to the plurality of pins 176 for operating the e-latch assembly 20 when the at least one entry input sensor 154 is not operable due to one of a power loss and malfunction of the at least one entry input sensor 154 (or other component of the entry system). While the plurality of pins 176 of the mechanical emergency switch assembly 170 include two pins 176 each electrically coupled to the electronic control circuit 46 of the e-latch assembly 20, other configurations of the switch 171 and pins 176 are possible. Also shown in FIG. 10 is a touch pad controller 177 of the touch pad 64 coupled to the at least one entry input sensor 154 and in communication with the electronic control circuit 46 of the e-latch assembly 20. Also shown in FIG. 10, the mechanical emergency switch assembly 170 may also include a plurality of pins 176 electrically coupled (illustrated as phantom electrical lines) to the touch pad controller 177.

Figure 11:
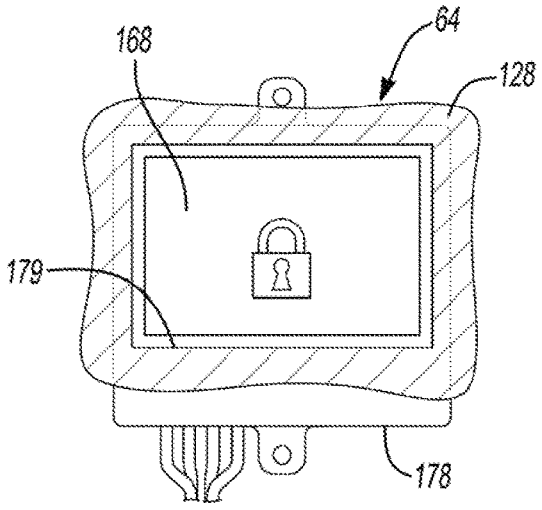
FIGS. 11 and 12 illustrate a front view of the touch pad according to aspects of the disclosure.
Figure 12:
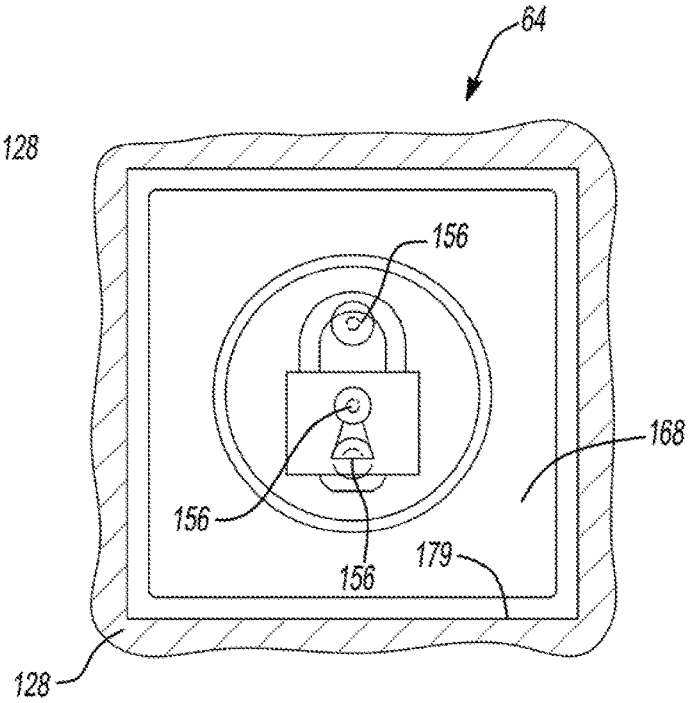

FIG. 11 illustrates the touch pad 64 including a touch pad housing 178 for encasing the touch pad printed circuit board 158. As shown, there is a gap 179 defined between the touch pad opening 166 in the applique 128 and the touch pad cover 168 to allow for movement of the touch pad cover 168 relative to the applique 128. FIG. 12 illustrates another view of the touch pad 64 that shows a pair of touch pad light emitting diodes 156 that are aligned with the at least one entry input sensor 154 (not shown in FIG. 12) and a single touch pad light emitting diode 156 is disposed above the pair of touch pad light emitting diodes 156 to provide a dual zone illumination configuration with a lower dual color first zone and an upper single color second zone to selectively illuminate an icon 167 provided on the cover pad cover 168. Illustratively, the icon 167 is a lock symbol, but other symbols or indicia may be provided touch pad cover 168.

Figure 13:
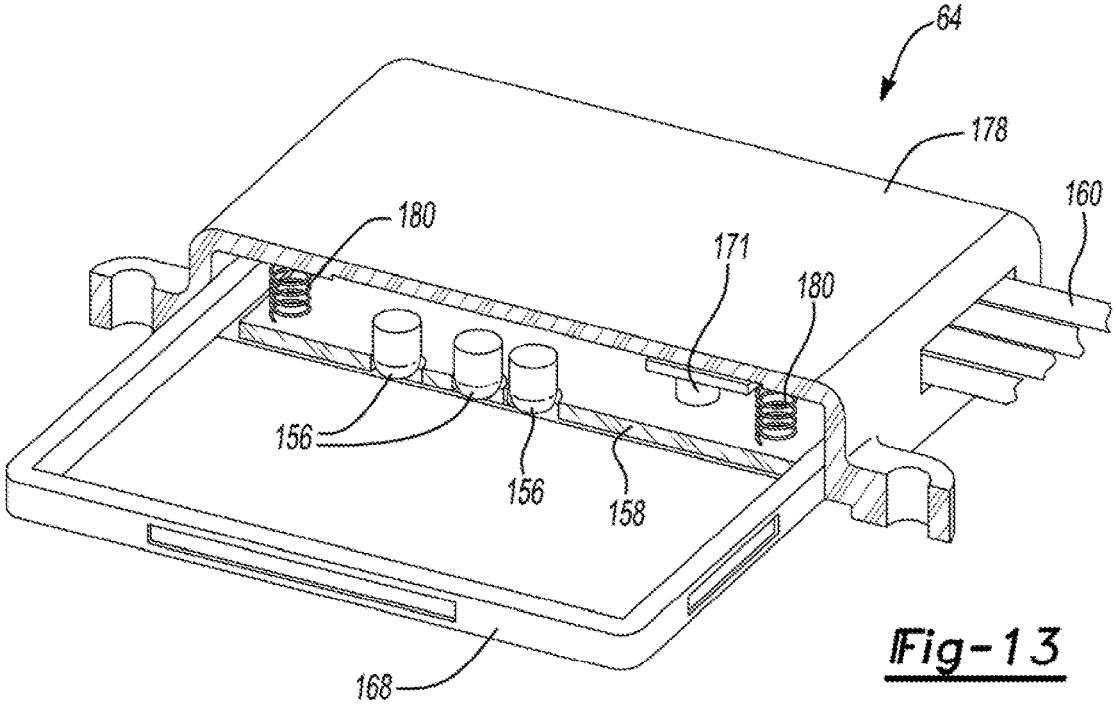
FIG. 13 is a partially-sectioned view of the touch pad according to aspects of the disclosure.
Figure 14:
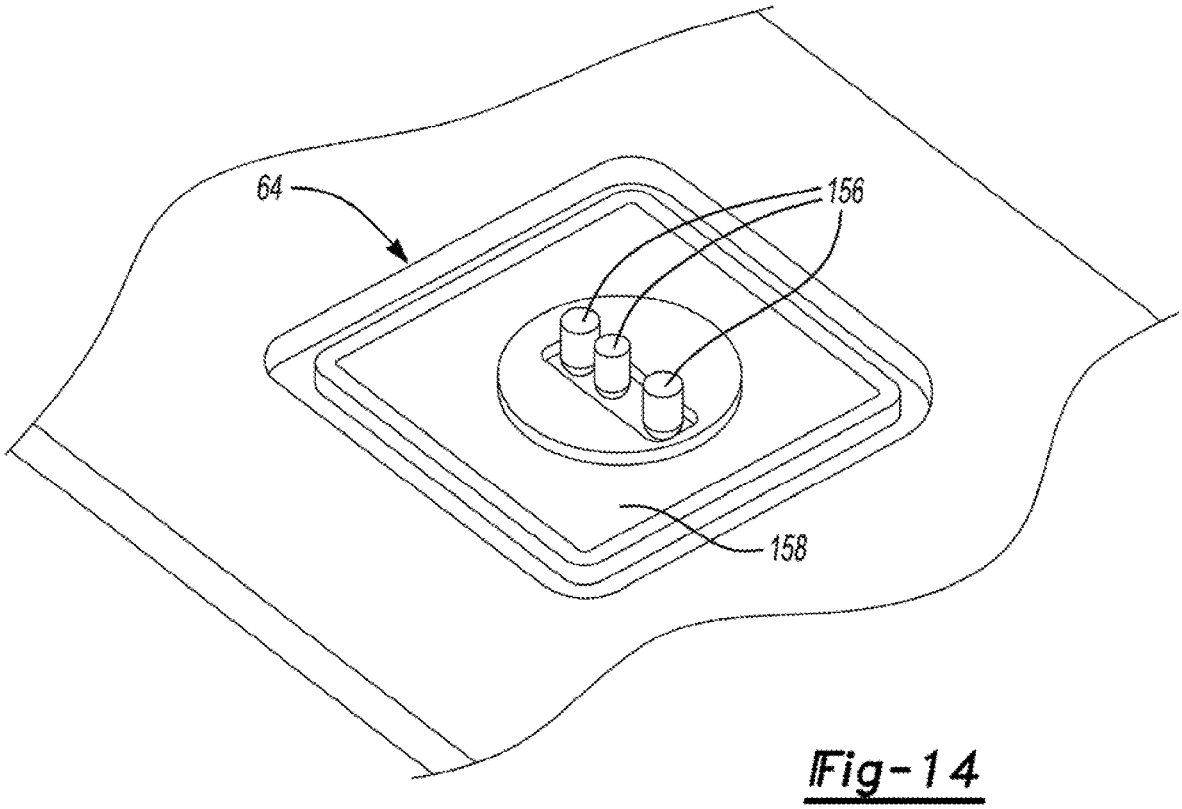
FIG. 14 illustrates a front view the touch pad with a touch pad cover removed and showing a plurality of touch pad light emitting diodes according to aspects of the disclosure.
Figure 15:
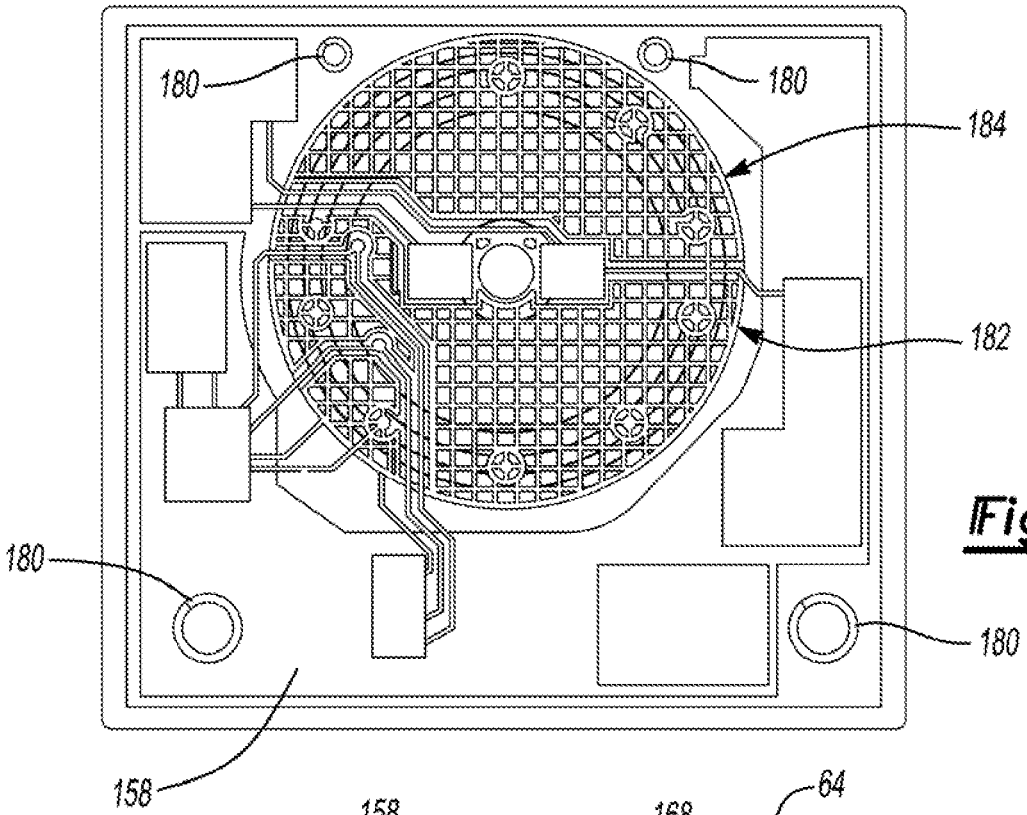
FIG. 15 illustrates rear view of a touch pad printed circuit board of the touch pad including a dual-zone capacitive touch configuration according to aspects of the disclosure.

FIG. 13 illustrates a partially-sectioned view of the touch pad 64. The touch pad printed circuit board 158 with the touch pad light emitting diodes is disposed adjacent the touch pad cover 168 and at least one spring 180 disposed between the touch pad printed circuit board 158 and the touch pad housing 178 (e.g., a bottom of the touch pad housing 178). The switch 171 (e.g., a microswitch) is disposed between the touch pad printed circuit board 158 and the touch pad housing 178 and configured to be switched or activated as the touch pad cover 168 and touch pad printed circuit board 158 are pushed into the touch pad housing 178 against the at least one spring 180. FIG. 14 shows another view of the touch pad 64, with the touch pad cover 168 removed and showing at least one capacitive touch pad 64. FIG. 15 illustrates a two-zone capacitive switch design associated with the touch pad printed circuit board 158 of touch pad 64. The touch pad printed circuit board 158 illustrates circuitry for a lower zone 182 and an upper zone 184 controlling operation of the at least one capacitive touch pad 64.

Figure 16:
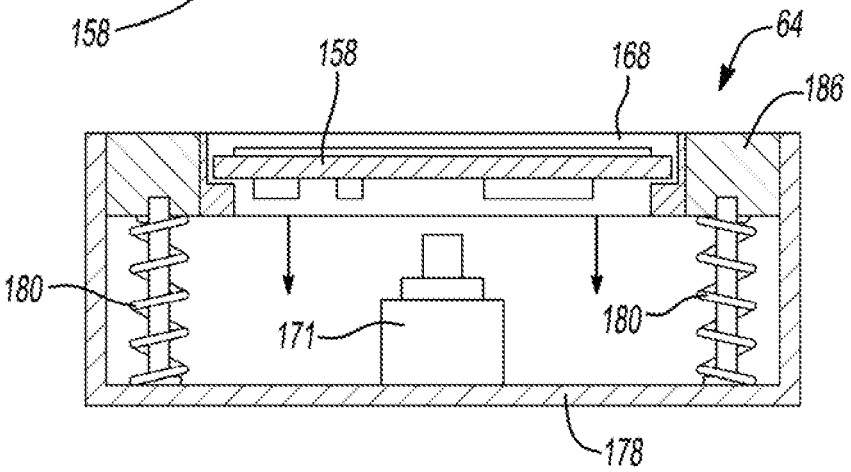
FIG. 16 is a cross-sectional view of the touch pad illustrating at least one spring and a mechanical emergency switch assembly according to aspects of the disclosure.
Figure 17:
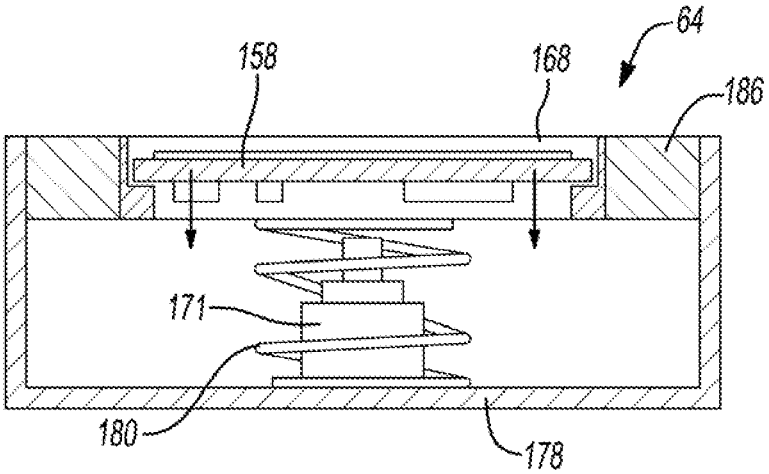
FIG. 17 is a cross-sectional view of the touch pad illustrating an alternative arrangement of the at least one spring with the mechanical emergency switch assembly according to aspects of the disclosure.
Figure 19:
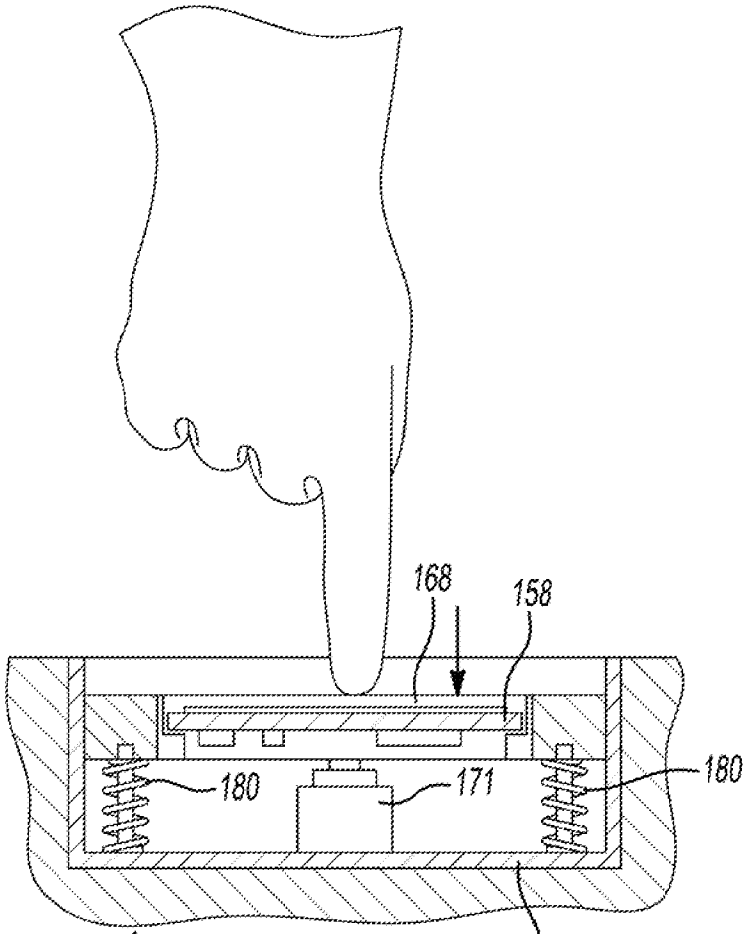
FIGS. 18 and 19 are cross-sectional views of the touch pad illustrating the mechanical emergency switch assembly of the touch pad in operation according to aspects of the disclosure.
Figure 18:
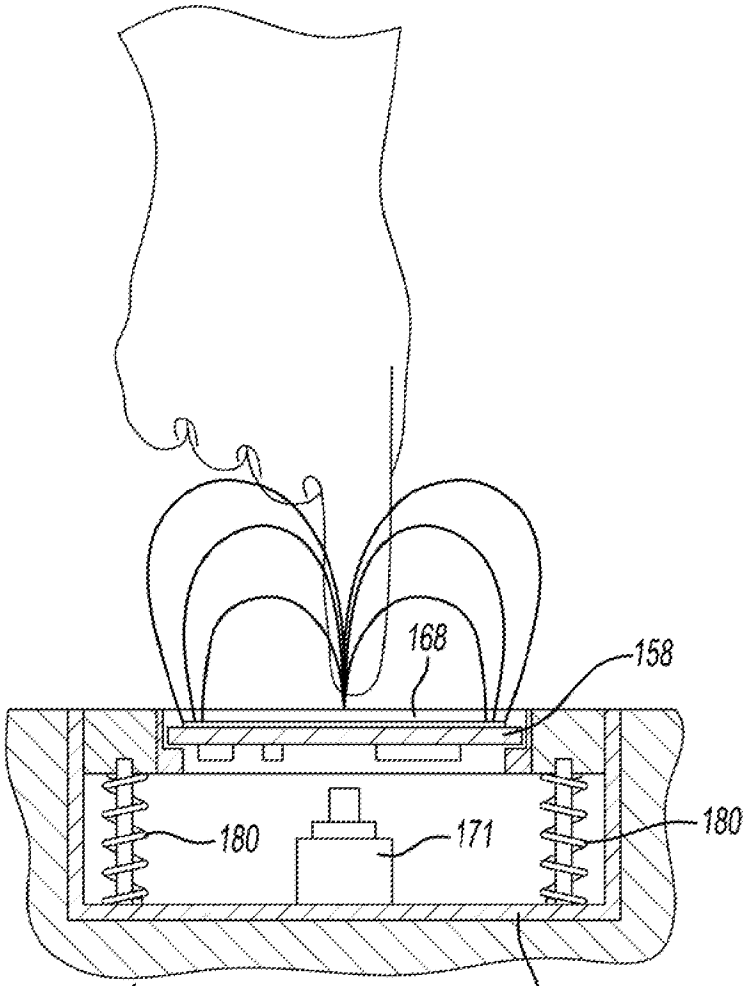

As best shown in FIG. 16, the touch pad 64 may include a frame 186 surrounding and supporting the touch pad printed circuit board 158, thus the at least one spring 180 supports the frame 186, which supports the touch pad printed circuit board 158. According to another aspect, the at least one spring 180 supports, such as directly supports, the touch pad printed circuit board 158. According to another aspect, the at least one spring 180 may be a single spring 180 disposed centrally (e.g., extending about the switch 171) between the frame 186 and the touch pad housing 178. Operation of the mechanical emergency switch assembly 170 is shown in FIGS. 18 and 19. Specifically, in FIG. 18, a user can activate the at least one entry input sensor 154 during normal operation (i.e., soft touch, to cause a disruption in electromagnetic field 71), but as shown in FIG. 19, the user may activate the switch 171 of the mechanical emergency switch assembly 170, if a soft touch does not work (e.g., in the case of a loss of power from the main power source 26 resulting in the electromagnetic field 71 not being generated). While the vehicle entry system 127 is shown as including a single mechanical emergency switch assembly 170 associated with the touch pad 64, it should be appreciated that the touch pad 64 and/or key pad 66 may include a plurality of emergency switch assemblies 170. For example, at each location or touch node of the at least one key pad input sensor 146 in the key pad 66, one mechanical emergency switch assembly 170 may be used, so that in an emergency, each touch node can be individually activated using the emergency switch assembly 170 at that touch node (e.g., the at least one key pad input sensor 146 at each touch node could be supported by the at least one spring 180 in the same way as described above for the entry input sensor 154 for the touch pad 64).

Figure 20:
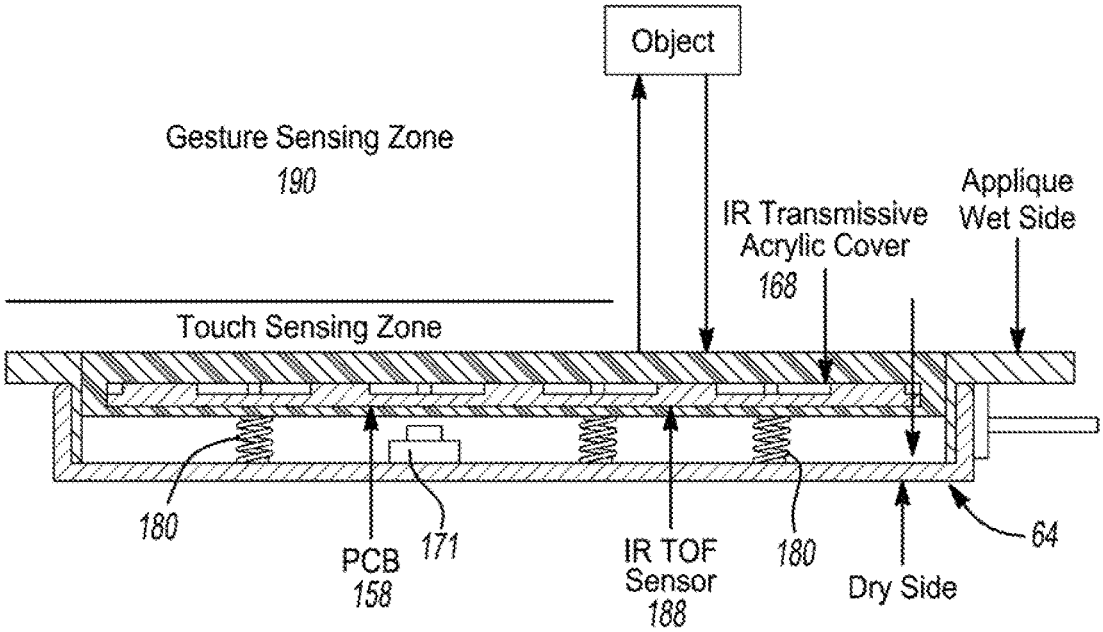
FIG. 20 is a cross-sectional view of a touch pad including at least one infrared (IR) time of flight sensor according to aspects of the disclosure.

According to an aspect and shown in FIG. 20, the at least one entry input sensor 154 is an infrared (IR) time of flight sensor 188 capable of not only sensing touch, but also able to sense gestures and objects within a gesture sensing zone 190. In this case, the touch pad printed circuit board 158 has a first side 172 facing the touch pad cover 168, which is formed of IR transmissive acrylic and a second side 174 for engaging the at least one spring 180 and for engaging the switch 171.

Figure 26:
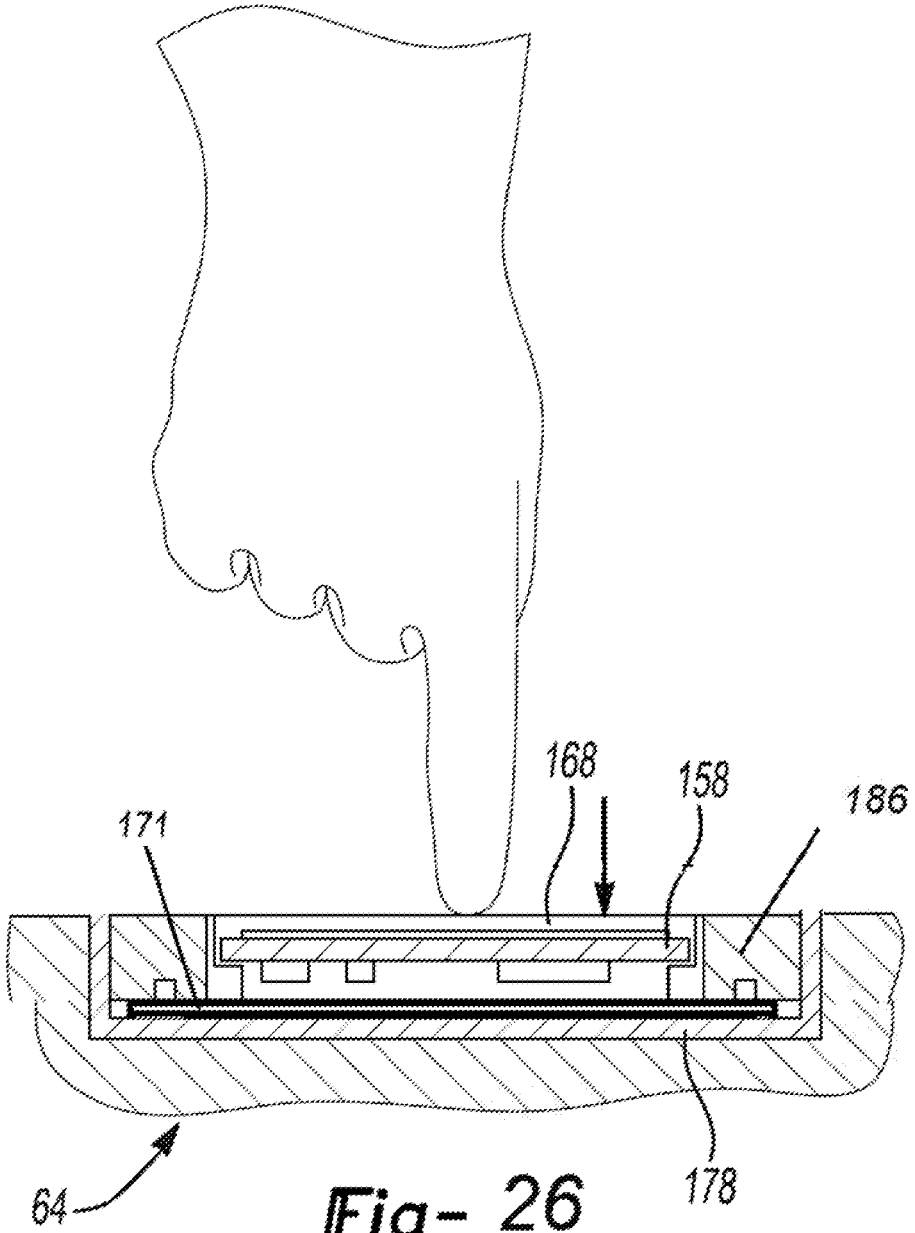
FIG. 26 is a cross-sectional view of the touch pad illustrating the mechanical emergency switch assembly with a force based sensor of the touch pad in operation according to another aspect of the disclosure.

Now referring to FIG. 26, in accordance with an alternate illustrative embodiment of the vehicle entry system 127, touch pad 64 may be provided with a mechanical emergency force sensor assembly 170' in lieu of mechanical emergency switch assembly 170 as described hereinabove. Mechanical emergency force sensor assembly 170' is configured to output different resistance values based on force applied on a force sensor 171' illustratively provided adjacent, such as below the at least one entry input sensor 154, such that a hard touch applied to the at least one entry input sensor 154 causes a detection by the force sensor 171' of the hard touch. The force sensor 171' is illustratively provided in electrical communication with the touch pad controller 177 and/or the control circuit 46 which are configured to detect the resistive output signal generated by the force sensor 171'. Upon determination of the exceeding of a certain detected resistance value, the touch pad controller 177 and/or the control circuit 46 is configured to determine that a hard touch of the mechanical emergency force sensor assembly 170' has occurred, indicative of the intention or command by a user to open the front door 22 of the motor vehicle 24. In an embodiment, force sensor 171' may be provided below the frame 186. In another embodiment, force sensor 171' may be provided between the touch pad printed circuit board 158 (PCB) and the frame 186. In another embodiment, force sensor 171' may be integrated on the touch pad printed circuit board 158 (PCB). A application of hard touch force to the touch pad cover 168 may result in a transfer of force to at least one of the touch pad cover 168, the touch pad printed circuit board 158 (PCB) and the frame 186 such that force sensor 171' can detect such a transfer of force.

Figure 21:
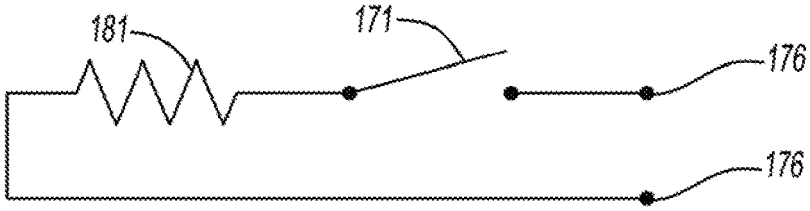
FIGS. 21-23 illustrate multiple mechanical emergency switch assembly circuit diagrams according to aspects of the disclosure.
Figure 22:
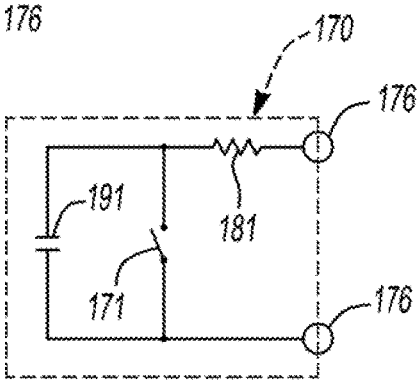

The mechanical emergency switch assembly 170 may be configured to be diagnosed by the electronic control circuit 46 and/or the touch pad controller 177 as illustrated in FIG. 10. Specifically, as best shown in FIGS. 21 and 22, the mechanical emergency switch assembly 170 can further include at least one resistor 181 connected in series with the switch 171 for diagnosing the mechanical emergency switch assembly 170. The at least one resistor 181 in series can, for example allow a different voltage to be detected at an input to a microcontroller (e.g., computing module 58). The mechanical emergency switch assembly 170 can alternatively or additionally include at least one capacitor 191 (FIG. 22) connected in parallel with the switch 171, which can also allow for diagnosing the mechanical emergency switch assembly 170.

Figure 23:
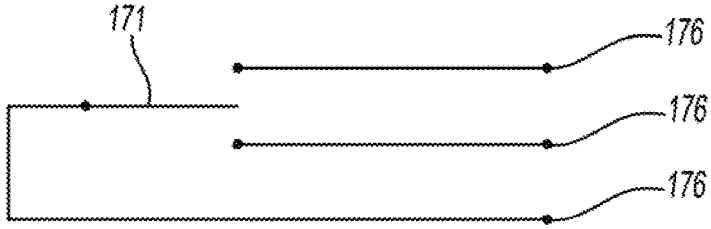

According to another aspect of the disclosure, and best shown in FIG. 23 the plurality of pins 176 of the mechanical emergency switch assembly 170 can include three pins 176, e.g., a single pole dual throw (SPDT) switch configuration, with each of the three pins 176 electrically coupled to the electronic control circuit 46 of the e-latch assembly 20 (e.g., the third pin 176 providing additional diagnostic capabilities). Such configurations of the mechanical emergency switch assembly 170 is illustrative of a diagnosable switch 171 assembly which avoids registering a false activation of a door release command due to a circuit failure, such as short circuit condition, in the mechanical emergency switch assembly 170, as would be the case of a single pole single throw (SPST) switch configuration having either open circuit or short circuit states due to a circuit failure. A diagnosable switch 171 provides specific values of resistance of the circuit rather than open (infinite Ω) and short circuit states (0Ω)). This permits circuit failures such as an open circuit or a shorted-to-ground circuit to be detected by microcontroller as different voltages at the input to the microcontroller (e.g., computing module 58), which can be diagnosed by the micro controller (e.g., computing module 58). Therefore, in accordance with an illustrative embodiment, the mechanical emergency switch assembly 170 is a diagnosable switch assembly. Such a diagnosable switch assembly avoids unintentional door releases due to circuit failures and enhances safety. Such a diagnosable switch assembly allows circuit failures to be detected before an occurrence of an emergency mode requiring the use of the mechanical emergency switch assembly 170. As such, the user may be alerted and the mechanical emergency switch assembly 170 repaired.

In operation, the electronic control circuit 46 can be configured to monitor the battery voltage Vbatt and the entry system continuously in a non-emergency mode. Accordingly, the electronic control circuit 46 can be configured to determine one of the loss of power from the main power source 26 and a failure of a component of the entry system and transition to an emergency mode in response to determining one of the loss of battery power and the component failure of the entry system. The electronic control circuit 46 can also be configured to poll the plurality of pins 176 of the mechanical emergency switch assembly 170 for an actuation of the mechanical emergency switch assembly 170 in the emergency mode. The electronic control circuit 46 can then determine whether the actuation from the plurality pins 176 of the mechanical emergency switch assembly 170 indicate a command from a user to unlatch the closure member in the emergency mode. Then, the electronic control circuit 46 can operate the actuation group 30 using power from the backup energy source 60 of the electronic control circuit 46 in response to determining that the actuation from the plurality pins 176 of the mechanical emergency switch assembly 170 indicates the command from the user to unlatch the closure member. Consequently, the mechanical emergency switch assembly 170 allows a user to directly command the operation of the e-latch assembly 20 in the case of an operational failure of the touch pad 64 and/or main power source 26.

Figure 24:
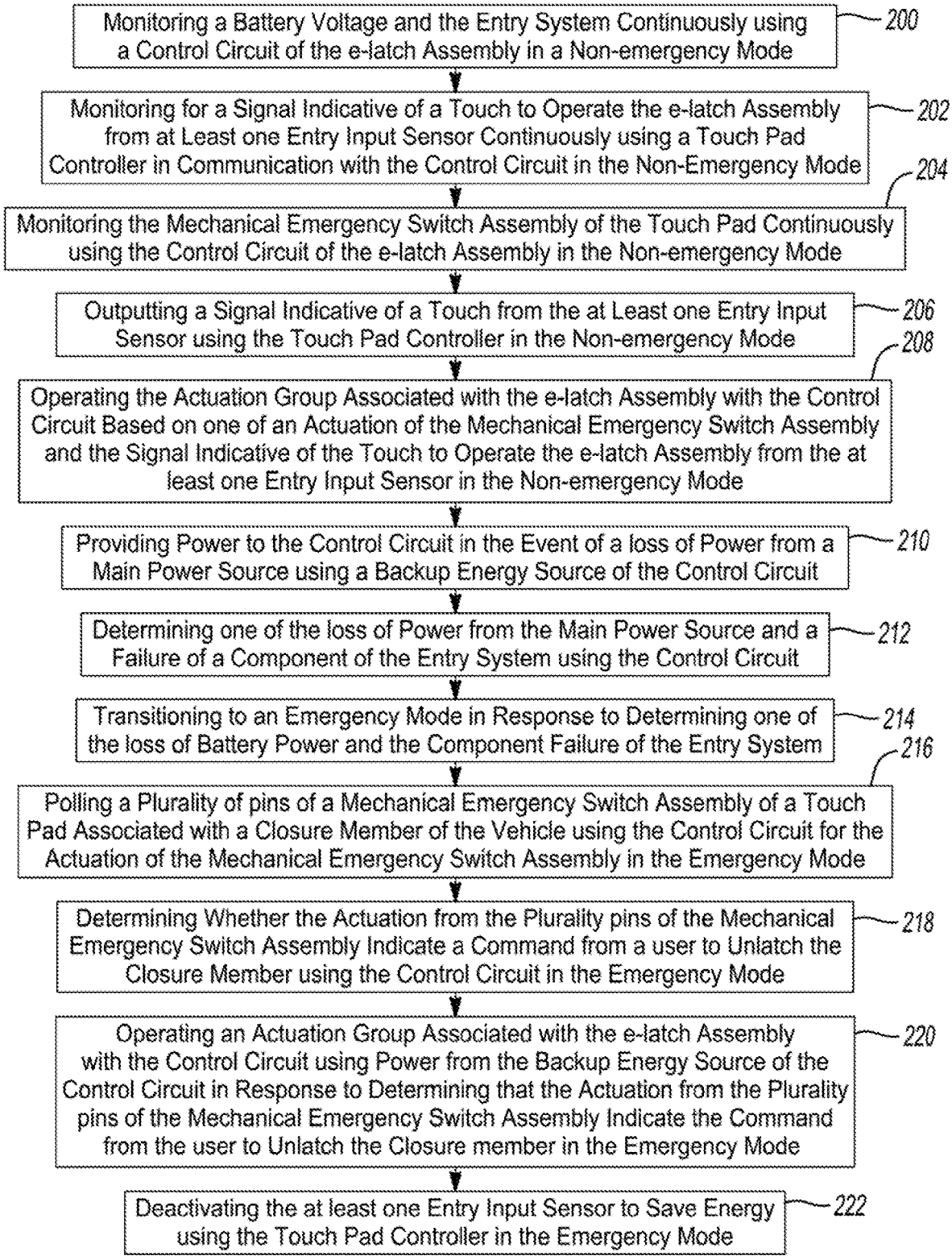
FIGS. 24 and 25 illustrate steps of a method of operating an entry system of a motor vehicle including an e-latch assembly according to aspects of the disclosure.
Figure 25:
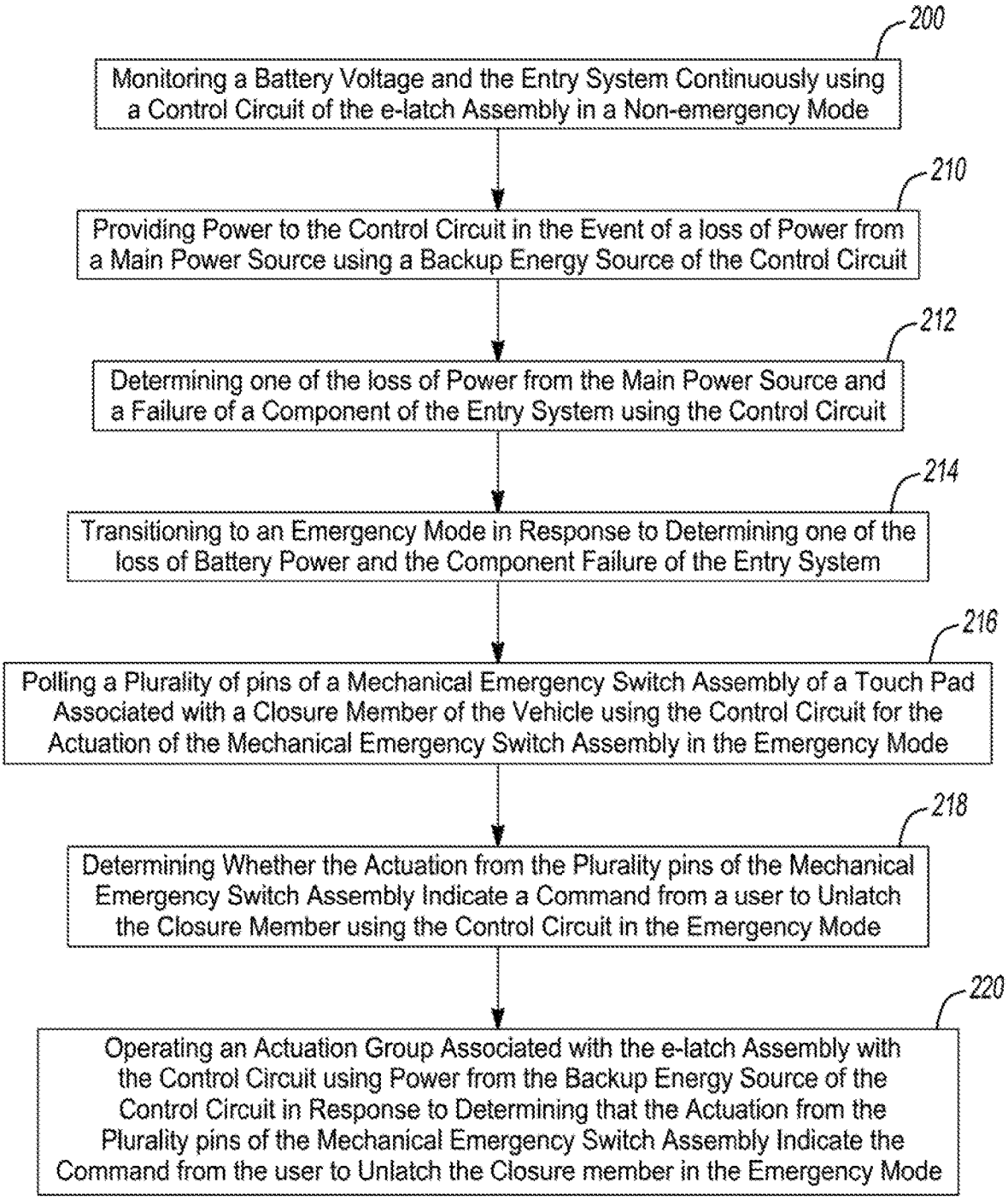

As best shown in FIGS. 24 and 25, a method of operating the entry system of the motor vehicle 24 is also provided. The method includes the step of 200 monitoring a battery voltage Vbatt and the vehicle entry system 127 continuously using an electronic control circuit 46 of the e-latch assembly 20 in a non-emergency mode. The method can also include the step of 202 monitoring for a signal indicative of a touch/selection to operate the e-latch assembly 20 from at least one entry input sensor 154 continuously using a touch pad controller 177 in communication with the electronic control circuit 46 in the non-emergency mode. Additionally, the method can also include the steps of 204 monitoring the mechanical emergency switch assembly 170 of the touch pad 64 continuously using the electronic control circuit 46 of the e-latch assembly 20 in the non-emergency mode and 206 outputting a signal indicative of a touch from the at least one entry input sensor 154 using the touch pad controller 177 in the non-emergency mode. The method can also include the step of 208 operating the actuation group 30 associated with the e-latch assembly 20 with the electronic control circuit 46 based on one of an actuation of the mechanical emergency switch assembly 170 and the signal indicative of the touch to operate the e-latch assembly 20 from the at least one entry input sensor 154 in the non-emergency mode.

However, once a loss of battery power or operational failure event has occurred, the at least one entry input sensor 154 will no longer be operational. So, the method continues by 210 providing power to the electronic control circuit 46 in the event of a loss of power from a main power source 26 using a backup energy source 60 of the electronic control circuit 46. The e-latch assembly 20 may be aware of its state (or the state of the battery or main power source 26) and transition to a mode where it polls the pins 176 of the mechanical emergency switch assembly 170, rather than polling the at least one entry input sensor 154, to look for a closure of mechanical emergency switch assembly 170 indicative of a command from a user to unlatch the front door or other closure member. Thus, the method proceeds with the step of 212 determining one of the loss of power from the main power source 26 and a failure of a component of the vehicle entry system 127 using the electronic control circuit 46. Next, 214 transitioning to an emergency mode in response to determining one of the loss of battery power and the component failure of the vehicle entry system 127. So, when the user soft touches the touch pad 64 (FIG. 18) and nothing happens, the user may proceed to activate the switch 171 of the mechanical emergency switch assembly 170, as shown in FIG. 19. The closing of the mechanical emergency switch assembly 170 is detected and the e-latch assembly 20 thus knows to operate the door function, such as an unlatching of the e-latch assembly 20 based on the closing of the mechanical emergency switch assembly 170. As discussed above, the unlatch operation may be powered by the backup energy source 60 forming part of the e-latch assembly 20. Thus, the method can then include the step of 216 polling a plurality of pins 176 of a mechanical emergency switch assembly 170 of a touch pad 64 associated with a closure member of the motor vehicle 24 using the electronic control circuit 46 for the actuation of the mechanical emergency switch assembly 170 in the emergency mode. The method continues with the step of 218 determining whether the actuation from the plurality pins 176 of the mechanical emergency switch assembly 170 indicate a command from a user to unlatch the closure member using the electronic control circuit 46 in the emergency mode. The method can also include the step of 220 operating an actuation group 30 associated with the e-latch assembly 20 with the electronic control circuit 46 using power from the backup energy source 60 of the electronic control circuit 46 in response to determining that the actuation from the plurality pins 176 of the mechanical emergency switch assembly 170 indicate the command from the user to unlatch the closure member in the emergency mode.

So, the e-latch assembly 20 continuously monitors both interfaces (the at least one entry input sensor 154 and mechanical emergency switch assembly 170) and the battery voltage Vbatt level. When a failure is detected, the at least one entry input sensor 154 or touch pad 64 may be turned off to save energy in the case a backup energy source 60 is supplying power to the electronic entry sensor or touch pad 64. Since the at least one entry input sensor 154 is off, it will not consume power, and polling the mechanical emergency switch assembly 170 requires insignificant power consumption, thereby extending the power of the backup power source 60 available during an emergency mode. Therefore, the method may also include the step of 222 deactivating the at least one entry input sensor 154 to save energy using the touch pad controller 177 in the emergency mode. Since the at least one entry input sensor 154 (i.e., capacitive pad) does not have to be powered from the backup energy source 60, energy is conserved. The activation of mechanical emergency switch assembly 170 will trigger the backup energy source 60 embedded in e-latch assembly 20 that will be then used to power a door unlatch operation. There is no connection between the at least one entry input sensor 154 and backup energy source 60 inside the e-latch assembly 20, thus avoiding any leakage from the backup energy source 60 due to the at least one entry input sensor 154.

The touch pad 64 with mechanical emergency switch assembly 170 and vehicle entry system 127 as disclosed herein advantageously provide a back-up system to the electronic touch pad 64 functionality (i.e., provides the user with the ability to command the operation of the e-latch assembly 20 in the case of an operational failure of the touch pad 64 and/or main power source 26, when the at least one entry input sensor 154 is unavailable to operate the e-latch assembly 20). The mechanical emergency switch assembly 170 does not consume any power while awaiting a command. Because such a back-up system is coupled to an e-latch assembly 20 with a backup energy source 60, the touch pad 64 with mechanical emergency switch assembly 170 and vehicle entry system 127 disclosed can allow for a physical lock/handle to be eliminated since the vehicle door can still be opened in case of a battery failure.

Clearly, changes may be made to what is described and illustrated herein without, however, departing from the scope defined in the accompanying claims. The e-latch assembly 20 may operate any kind of different closure devices within the motor vehicle 24, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Those skilled in the art will recognize that concepts disclosed in association with the example entry system can likewise be implemented into many other systems to control one or more operations and/or functions.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

The invention claimed is:

1. A method of operating an entry system of a motor vehicle including a latch assembly, the method comprising the steps of:

monitoring a battery voltage from a main power source, where the entry system continuously using a control circuit of the latch assembly in a non-emergency mode;

providing power to the control circuit in the event of a loss of power from the main power source using a backup energy source of the control circuit;

determining, using the control circuit, one selected from the group consisting of (i) the loss of power from the main power source and (ii) a failure of a component of the entry system;

transitioning to an emergency mode in response to determining the one selected from the group consisting of the loss of power from the main power source and the failure of the component of the entry system;

polling a plurality of pins of a mechanical emergency switch assembly of a touch pad associated with a closure member of the motor vehicle using the control circuit for actuation of the mechanical emergency switch assembly in the emergency mode;

determining whether the actuation from the plurality of pins of the mechanical emergency switch assembly indicate a command from a user to unlatch the closure member using the control circuit in the emergency mode; and operating an actuation group associated with the latch assembly with the control circuit using power from the backup energy source of the control circuit in response to determining that the actuation from the plurality of pins of the mechanical emergency switch assembly indicate the command from the user to unlatch the closure member in the emergency mode.

2. The method as set forth in claim 1, further including the steps of:

monitoring for a signal indicative of a touch to operate the latch assembly from at least one touch entry sensor continuously using a touch pad controller in communication with the control circuit in the non-emergency mode;

monitoring the mechanical emergency switch assembly of the touch pad continuously using the control circuit of the latch assembly in the non-emergency mode;

outputting a signal indicative of a touch from the at least one touch entry sensor using the touch pad controller in the non-emergency mode; and operating the actuation group associated with the latch assembly with the control circuit based on one of an actuation of the mechanical emergency switch assembly and the signal indicative of the touch to operate the latch assembly from the at least one touch entry sensor in the non-emergency mode.

3. The method as set forth in claim 2, further including the step of deactivating the at least one touch entry sensor to save energy using the touch pad controller in the emergency mode.

4. The method as set forth in claim 2, wherein the mechanical emergency switch assembly is positioned adjacent the at least one touch entry sensor.

5. The method as set forth in claim 2, wherein the mechanical emergency switch assembly is disposed behind the at least one touch entry sensor.

6. The method as set forth in claim 2, wherein the at least one touch entry sensor is capacitive.

7. The method as set forth in claim 1, wherein the control circuit is configured to be normally powered by the main power source of the motor vehicle.

8. The method as set forth in claim 1, wherein the plurality of pins of the mechanical emergency switch assembly includes two pins each electrically coupled to the control circuit of the latch assembly and a switch electrically coupled to the plurality of pins.

9. The method as set forth in claim 8, wherein the mechanical emergency switch assembly further includes at least one resistor connected in series with the switch for diagnosing the mechanical emergency switch assembly.

10. The method as set forth in claim 8, wherein the touch pad further includes at least one capacitor connected in parallel with the switch for diagnosing the mechanical emergency switch assembly.

11. The method as set forth in claim 1, wherein the plurality of pins of the mechanical emergency switch assembly includes three pins each electrically coupled to the control circuit of the latch assembly and a switch electrically coupled to the plurality of pins.

12. A method of operating an entry system of a motor vehicle including a latch assembly, the method comprising the steps of:

monitoring a battery voltage from a main power source, where the entry system continuously using a control circuit of the latch assembly in a non-emergency mode;

providing power to the control circuit in the event of a loss of power from the main power source using a backup energy source of the control circuit;

determining, using the control circuit, one selected from the group consisting of (i) the loss of power from the main power source and (ii) a failure of a component of the entry system;

transitioning to an emergency mode in response to determining the one selected from the group consisting of the loss of power from the main power source and the failure of the component of the entry system;

polling a plurality of pins of a mechanical emergency switch assembly of a touch pad associated with a closure member of the motor vehicle using the control circuit for actuation of the mechanical emergency switch assembly in the emergency mode;

determining whether the actuation from the plurality of pins of the mechanical emergency switch assembly indicate a command from a user to unlatch the closure member using the control circuit in the emergency mode;

operating an actuation group associated with the latch assembly with the control circuit using power from the backup energy source of the control circuit in response to determining that the actuation from the plurality of pins of the mechanical emergency switch assembly indicate the command from the user to unlatch the closure member in the emergency mode;

wherein the control circuit is configured to be normally powered by the main power source of the motor vehicle when operating in the non-emergency mode;

outputting a signal indicative of a touch from at least one touch entry sensor using a touch pad controller in the non-emergency mode; and operating the actuation group associated with the latch assembly with the control circuit based on one of an actuation of the mechanical emergency switch assembly and the signal indicative of the touch to operate the latch assembly from the at least one touch entry sensor in the non-emergency mode.

13. The method as set forth in claim 12, further including the step of deactivating the at least one touch entry sensor to save energy using the touch pad controller in the emergency mode.

14. The method as set forth in claim 12, wherein the mechanical emergency switch assembly is positioned adjacent the at least one touch entry sensor.

15. The method as set forth in claim 12, wherein the mechanical emergency switch assembly is disposed behind the at least one touch entry sensor.

16. The method as set forth in claim 12, wherein the plurality of pins of the mechanical emergency switch assembly includes two pins each electrically coupled to the control circuit of the latch assembly and a switch electrically coupled to the plurality of pins.

17. The method as set forth in claim 16, wherein the mechanical emergency switch assembly further includes at least one resistor connected in series with the switch for diagnosing the mechanical emergency switch assembly.

18. The method as set forth in claim 16, wherein the touch pad further includes at least one capacitor connected in parallel with the switch for diagnosing the mechanical emergency switch assembly.

19. The method as set forth in claim 12, wherein the plurality of pins of the mechanical emergency switch assembly includes three pins each electrically coupled to the control circuit of the latch assembly and a switch electrically coupled to the plurality of pins.

20. A method of operating an entry system of a motor vehicle including a latch assembly, the method comprising the steps of:

monitoring a battery voltage from a main power source where the entry system continuously using a control circuit of the latch assembly in a non-emergency mode;

wherein the control circuit is configured to be normally powered by the main power source of the motor vehicle;

providing power to the control circuit in the event of a loss of power from the main power source using a backup energy source of the control circuit;

determining, using the control circuit, one selected from the group consisting of (i) the loss of power from the main power source and (ii) a failure of a component of the entry system;

transitioning to an emergency mode in response to determining the one selected from the group consisting of the loss of power from the main power source and the failure of the component of the entry system;

polling a plurality of pins of a mechanical emergency switch assembly of a touch pad associated with a closure member of the motor vehicle using the control circuit for actuation of the mechanical emergency switch assembly in the emergency mode;

wherein the plurality of pins of the mechanical emergency switch assembly includes two pins each electrically coupled to the control circuit of the latch assembly and a switch electrically coupled to the plurality of pins;

determining whether the actuation from the plurality of pins of the mechanical emergency switch assembly indicate a command from a user to unlatch the closure member using the control circuit in the emergency mode; and operating an actuation group associated with the latch assembly with the control circuit using power from the backup energy source of the control circuit in response to determining that the actuation from the plurality of pins of the mechanical emergency switch assembly indicate the command from the user to unlatch the closure member in the emergency mode.

21. The method as set forth in claim 20, wherein the mechanical emergency switch assembly further includes at least one resistor connected in series with the switch for diagnosing the mechanical emergency switch assembly.

22. The method as set forth in claim 20, wherein the touch pad further includes at least one capacitor connected in parallel with the switch for diagnosing the mechanical emergency switch assembly.

* * * * *